US008267714B2

(12) United States Patent
Siemon et al.

(10) Patent No.: US 8,267,714 B2
(45) Date of Patent: Sep. 18, 2012

(54) MODULAR CONNECTOR WITH REDUCED TERMINATION VARIABILITY AND IMPROVED PERFORMANCE

(75) Inventors: John A Siemon, Woodbury, CT (US); Brian Celella, Southington, CT (US); James Frey, Woodbury, CT (US); David Medeiros, Watertown, CT (US); Maxwell K. Yip, Trumbull, CT (US); Joseph Favale, Watertown, CT (US); Randy J. Below, Cheshire, CT (US); Chris Acuna, Oakville, CT (US); Marc Pardee, Waterbury, CT (US)

(73) Assignee: The Siemon Company, Watertown, CT (US)

( * ) Notice: Subject to any disclaimer, the term of this patent is extended or adjusted under 35 U.S.C. 154(b) by 136 days.

(21) Appl. No.: 12/058,004

(22) Filed: Mar. 28, 2008

(65) Prior Publication Data

US 2008/0268719 A1 Oct. 30, 2008

Related U.S. Application Data

(60) Provisional application No. 60/920,772, filed on Mar. 29, 2007.

(51) Int. Cl.
*H01R 4/24* (2006.01)

(52) U.S. Cl. ..... 439/404; 439/418; 439/470; 439/676

(58) Field of Classification Search ..... 439/404, 439/417, 418, 676, 941, 465, 467, 470, 607.41, 439/607.43

See application file for complete search history.

(56) References Cited

U.S. PATENT DOCUMENTS

| | | | | |
|---|---|---|---|---|
| 5,411,414 | A * | 5/1995 | House et al. | 439/540.1 |
| 5,662,493 | A * | 9/1997 | Reichle | 439/409 |
| 5,885,111 | A * | 3/1999 | Yu | 439/676 |
| 5,911,594 | A * | 6/1999 | Baker et al. | 439/404 |
| 6,050,842 | A * | 4/2000 | Ferrill et al. | 439/404 |
| 6,116,965 | A * | 9/2000 | Arnett et al. | 439/692 |
| 6,193,526 | B1 | 2/2001 | Milner et al. | |
| 6,315,596 | B1 * | 11/2001 | Chen | 439/417 |
| 6,371,794 | B1 * | 4/2002 | Bauer et al. | 439/404 |
| 6,582,247 | B2 * | 6/2003 | Siemon | 439/405 |
| 6,682,363 | B1 * | 1/2004 | Chang | 439/409 |
| 6,854,998 | B2 * | 2/2005 | Yuan | 439/404 |
| 7,025,621 | B2 * | 4/2006 | Mossner et al. | 439/395 |
| 7,114,987 | B2 * | 10/2006 | Nad | 439/470 |
| 7,384,298 | B2 * | 6/2008 | Caveney et al. | 439/404 |
| 7,404,739 | B2 * | 7/2008 | Sheilds et al. | 439/607.05 |
| 7,604,515 | B2 * | 10/2009 | Siemon et al. | 439/676 |
| 2006/0148325 | A1 | 7/2006 | Hashim | |
| 2009/0149082 | A1 | 6/2009 | Leubner | |

FOREIGN PATENT DOCUMENTS

| | | | |
|---|---|---|---|
| JP | 2001118642 | A | 4/2001 |
| JP | 2004296250 | A | 10/2004 |
| JP | 2006520070 | A | 8/2006 |
| JP | 2007529098 | A | 10/2007 |

* cited by examiner

*Primary Examiner* — Xuong Chung Trans
(74) *Attorney, Agent, or Firm* — Cantor Colburn LLP

(57) ABSTRACT

A telecommunications connector including a connector housing; a plurality of connector contacts in the connector housing; a substrate having first plated through holes for receiving termination ends of the connector contacts, the first plated through holes arranged in an area on the substrate; a plurality of termination contacts, the plurality of termination contacts positioned in second plated through holes in the substrate; the second plated through holes intersecting the area on the substrate.

18 Claims, 29 Drawing Sheets

4 PAIR TELECOMMUNICATION CABLE

MODULAR CONNECTOR WITH REDUCED TERMINATION VARIABILITY AND IMPROVED PERFORMANCE

CROSS-REFERENCE TO RELATED APPLICATIONS

This application claims the benefit of U.S. provisional patent application Ser. No. 60/920,772 filed Mar. 29, 2007, the entire contents of which are incorporated herein by reference.

BACKGROUND

As telecommunications applications require higher frequency performance and more controlled performance per standards such as IEEE 10 GBASE-T, ISO/IEC 11801 Ed 2, IEC 60603-7-41, etc., the minimization of installation variability becomes critical. This includes the performance of patch cords (e.g., twisted pair cable terminated to modular plugs), connectors (e.g., outlets or jacks having printed circuit board (PCB) or lead frame connections to various terminal blocks), and the termination from twisted pair cable to the connectors. The overall system performance can be improved by limiting the variability of these components.

Telecommunications connectors are often used with multi-pair cable. The inherent nature of twisted pair cable results in a mirror image pattern on opposing ends when a cable is terminated. The wire lay (pairs of wires twisted around each other over a predetermined length) results in an orientation of pairs in one end that is a mirror image of the other end. Existing standard plug and outlet designs have termination patterns that require at least one end of the cable to cross pairs to align them properly for termination. This crossing of pairs results in variation and additional unpredictable crosstalk.

In addition, the alignment of the terminating contacts (e.g., IDCs) from one connector to another connector can cause crosstalk between individual connectors. This is known as alien crosstalk. One of the best ways to minimize or eliminate alien crosstalk is to create space between connectors, however application requirements continue to maximize the use of space where the connectors are located and this results in the connectors being closer together to create high density arrangements. As an example, 48 connectors in a 1U patch panel.

Thus, there is a need in the art for a telecommunications connector having reduced termination variability to improve performance (e.g., crosstalk reduction) of the connectors, along with a termination IDC orientation which maximizes distance from one connector to a neighboring connector when placed in close proximity.

SUMMARY

Embodiments include a telecommunications connector including a connector housing; a plurality of connector contacts in the connector housing; a substrate having first plated through holes for receiving termination ends of the connector contacts, the first plated through holes arranged in an area on the substrate; a plurality of termination contacts, the plurality of termination contacts positioned in second plated through holes in the substrate; the second plated through holes intersecting the area on the substrate.

DETAILED DESCRIPTION

Figure 1:
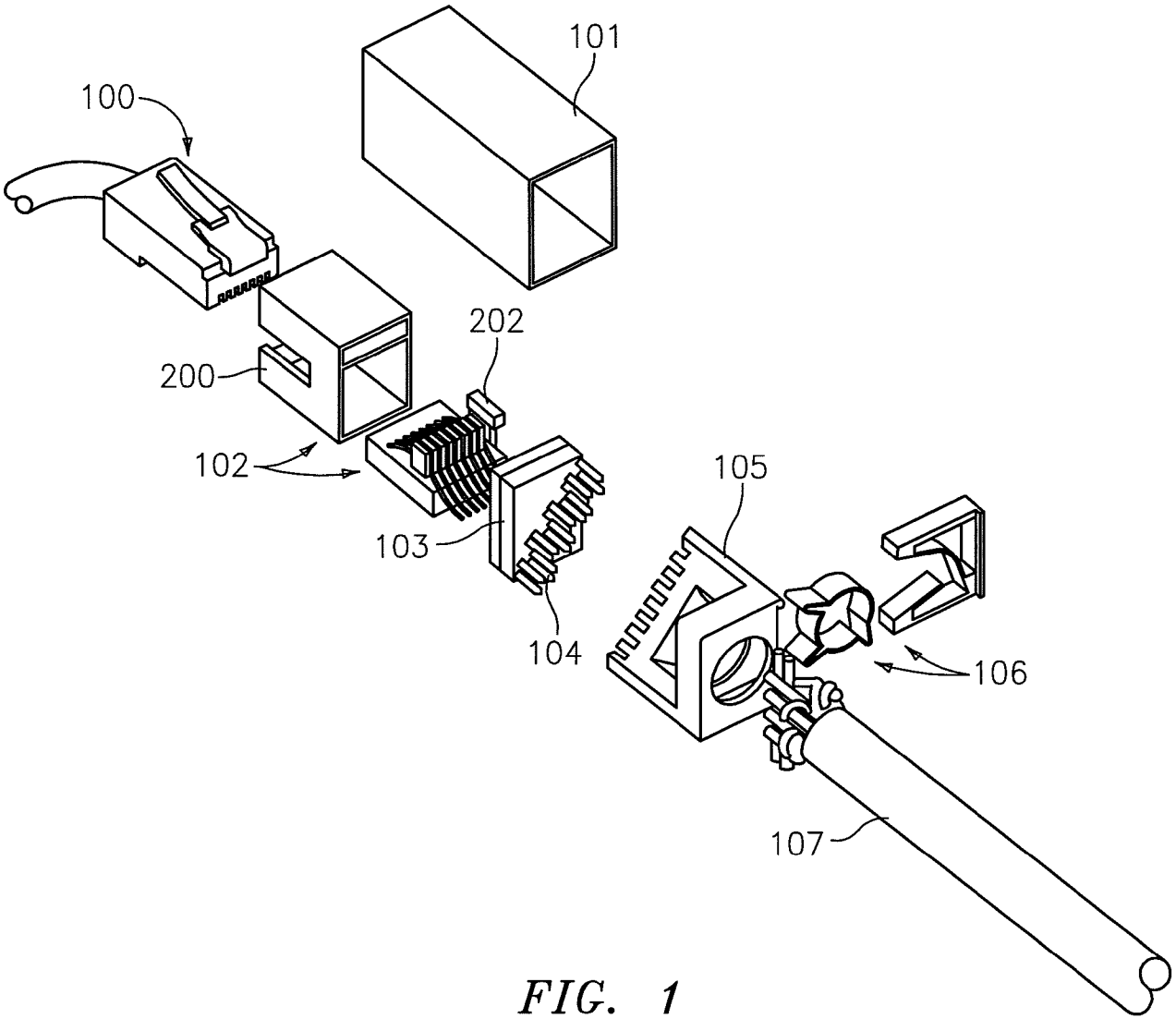
FIG. 1 is an exploded view of an exemplary connector in embodiments of the invention.

FIG. 1 is an exploded view of an exemplary connector housing 101, patch cord 100 and twisted pair cable 107. Cable 107 includes four twisted pairs of wires 108 (FIG. 2A), each twisted pair having a color coded tip and ring wire. It is understood that embodiments of the invention may be used with cables having a different color code and the invention is not limited to cables having four twisted pairs of wires. The patch cord 100 includes a plug housing dimensioned to mate with existing modular outlets. The plug housing may be an RJ-45 type plug, but may have different configurations.

Connector housing 101 contains a number of components. A connector assembly 102 includes a connector housing 200 and a contact carrier 202. The connector in FIG. 1 is an outlet, but it is understood that features of the invention may be incorporated in a variety of connectors. The contact carrier 202 includes connector contacts for making electrical contact with plug contacts in the plug on patch cord 100. The connector contacts may be wire form, flexible circuit material, etc. A substrate 103 establishes an electrical connection between the connector contacts on contact carrier 102 and termination contacts 104. The termination contacts 104 (e.g., insulation displacement contacts) are positioned to engage wires laced in the termination block 105 as described in further detail herein. The substrate 103 may be a printed circuit board, flexible circuit material, etc. having traces therein for establishing electrical connection between the contacts in the connector assembly 102 and termination contacts 104. As described in further detail herein, the substrate 103 may include compensation elements for tuning electrical performance of the connector (e.g., NEXT, FEXT). In alternate embodiments, the connector assembly contacts and termination contacts 104 are part of a lead frame, eliminating the need for substrate 103. Connector housing 101 may be conductive to provide shielding. A strain relief and shield grounding assembly 106 is provided in the base of the termination block 105. Strain relief and shield grounding assembly 106 is described in further detail with reference to FIG. 29.

Figure 2A:
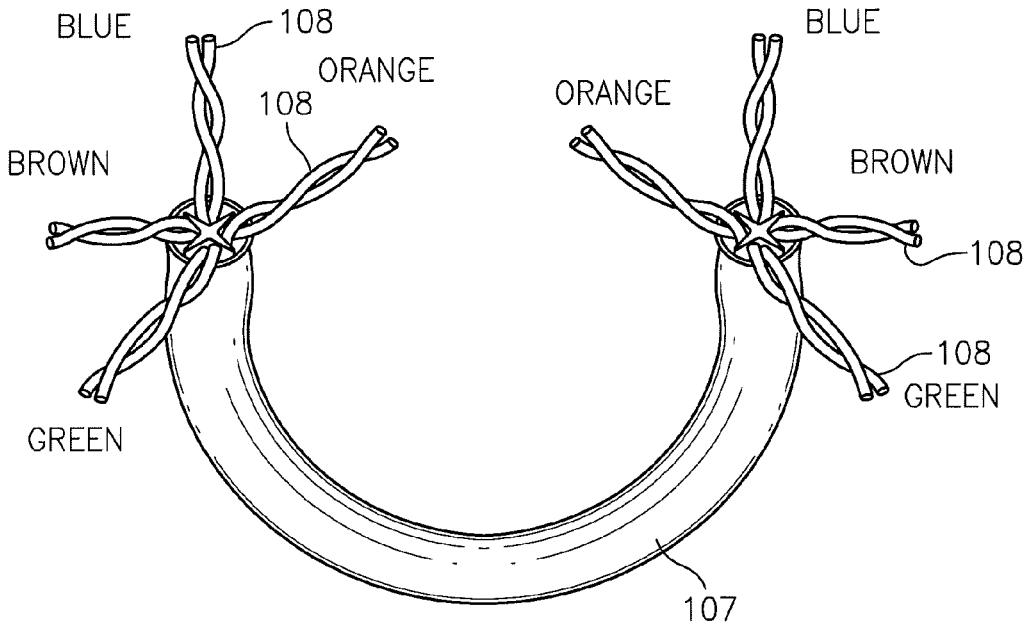
FIGS. 2A-2C illustrate standard 4-pair telecommunications cable, including color codes of individual pairs.
Figure 2B:
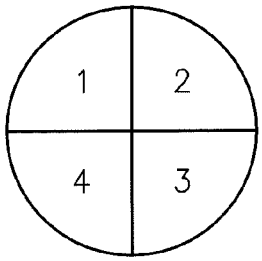
Figure 2C:
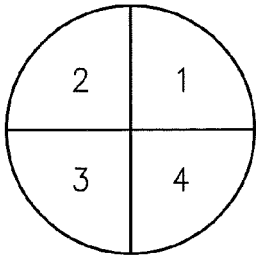

As shown in FIG. 2A, the opposite ends of the cable 107 are mirror images of each other, with respect to the location of the wire pairs. FIGS. 2B and 2C depict opposite ends of a cable, showing the position of pairs 1 through 4. This orientation of the wire pairs in the cable has typically led to crossing pairs of wires when the cable is terminated to a connector. Typically, if pairs are uncrossed when terminated at one end of cable 107, then the pairs must be rearranged and crossed at the other end of the cable. This is due to the fact that conventional connectors are identical at each end of the cable, but the wire pair locations are different at each end of the cable. In this conventional arrangement, if wire pairs at one end are uncrossed, the wire pairs at the other end of the cable will necessarily be crossed. Embodiments of the invention eliminate this problem.

The pair locations are often represented by the designators OR/W (orange white wire) and OR (orange wire), BL/W (blue white wire) and BL (blue wire), GR/W (green white wire) and GR (green wire), and BR/W (brown white wire) and BR (brown wire). Reference to the "blue pair", for example, refers to the blue and blue/white wire.

Figure 3:
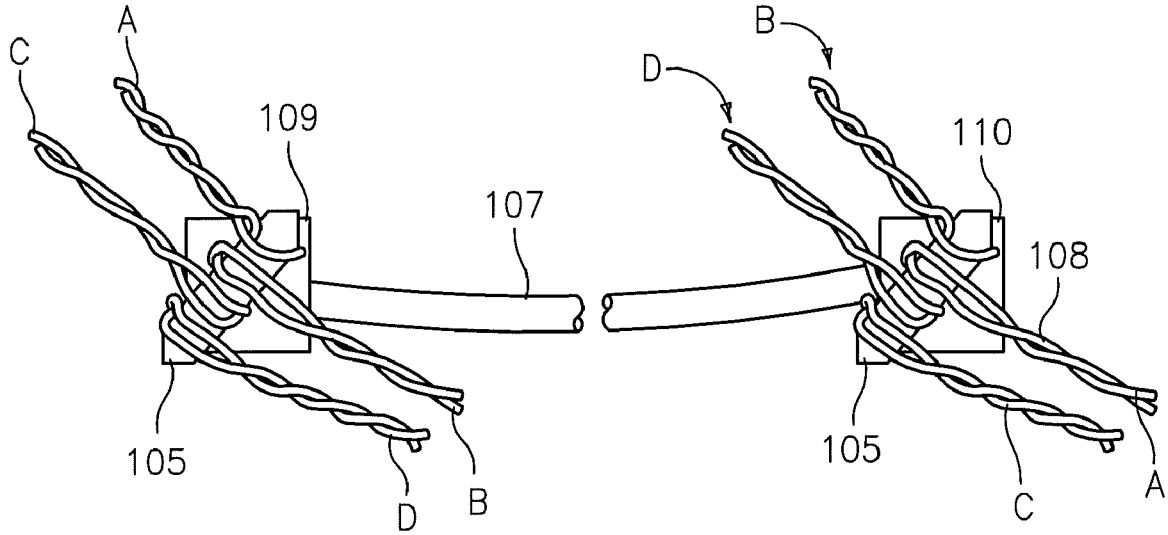
FIG. 3 illustrates termination blocks on both ends of a cable that allow for the twisted pair cable to be laced for termination, without pair crossing.
Figure 4A:
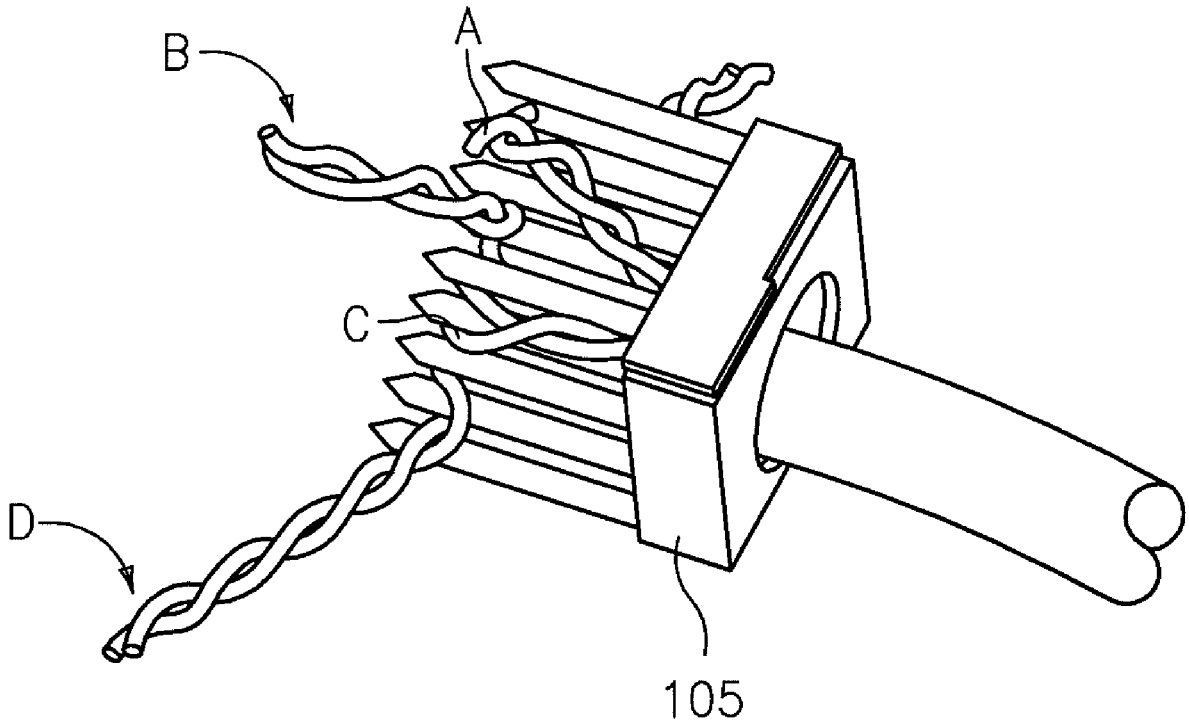
FIG. 4A illustrates lacing of wires in the termination block in exemplary embodiments.

FIGS. 3 and 4A illustrate a four pair telecommunications cable 107 having twisted pairs of wires 108. As is typical in the art, the pairs are colored with a solid color wire twisted with another wire having the same color and the color white (e.g., one twisted pair has a blue wire and a blue/white wire twisted). Embodiments of the invention are not limited to particular wire styles and/or colors.

FIG. 3 illustrates lacing of cable wire pairs 108 at each end of the cable to a termination block 105. The termination is such that two wire pairs enter from one side, and the other two wire pairs enter from the opposite side of the terminating bar 306. As shown, at end 109, the orange pair of wires (B) and the blue pair of wires (D) are terminated to the termination block 105 coming from the left hand side of the bar 306. The green pair of wires (A) and brown pair of wires (C) are terminated to the termination block 105 coming from the right side of the bar 306. At the other end 110, the orange pair of wires and the blue pair of wires are terminated to the termination block 105 coming from the right hand side of the bar 306. The green pair of wires and brown pair of wires are terminated to the termination block 105 coming from the left side of the bar 306. When terminating both sides of the cable 107 to the same block, the user does not need to arrange the conductors differently for both sides. The conductors follow the natural lay of the conductors for a given cable.

As shown in FIGS. 3 and 4A, the ends of wires 108 extend beyond the termination bar and may be trimmed by an installer or in a factory setting. The length of the wire stubs extending beyond the termination bar may be adjusted so as to control electrical performance of the modular connector (e.g., crosstalk). Further, the height of the wires relative to the termination block base 302 may be adjusted by using termination contacts 104 and slots 310 having differing heights to control interaction between wires 108 and control electrical performance of the modular connector (e.g., crosstalk).

Figure 4B:
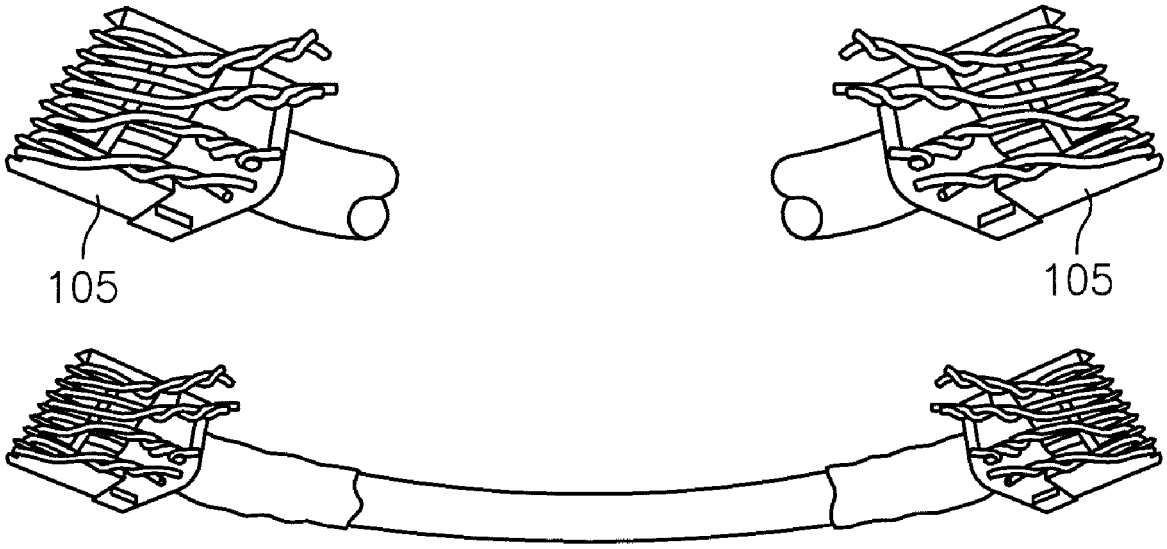
FIG. 4B illustrates lacing of wires in the termination block in exemplary embodiments.

FIG. 4B illustrates lacing of wires into the termination block 105 similar to that shown in FIGS. 3 and 4A. In this embodiment, however, the wires are all laced along one side of the termination block 105 rather than being laced from both sides as shown in FIG. 3. With either method of lacing, there is no need to cross pairs of wires at either end of the cable as the termination block 105 allows the wires pairs to be laced without disrupting the natural lay of the wire pairs in the cable.

Figure 4C:
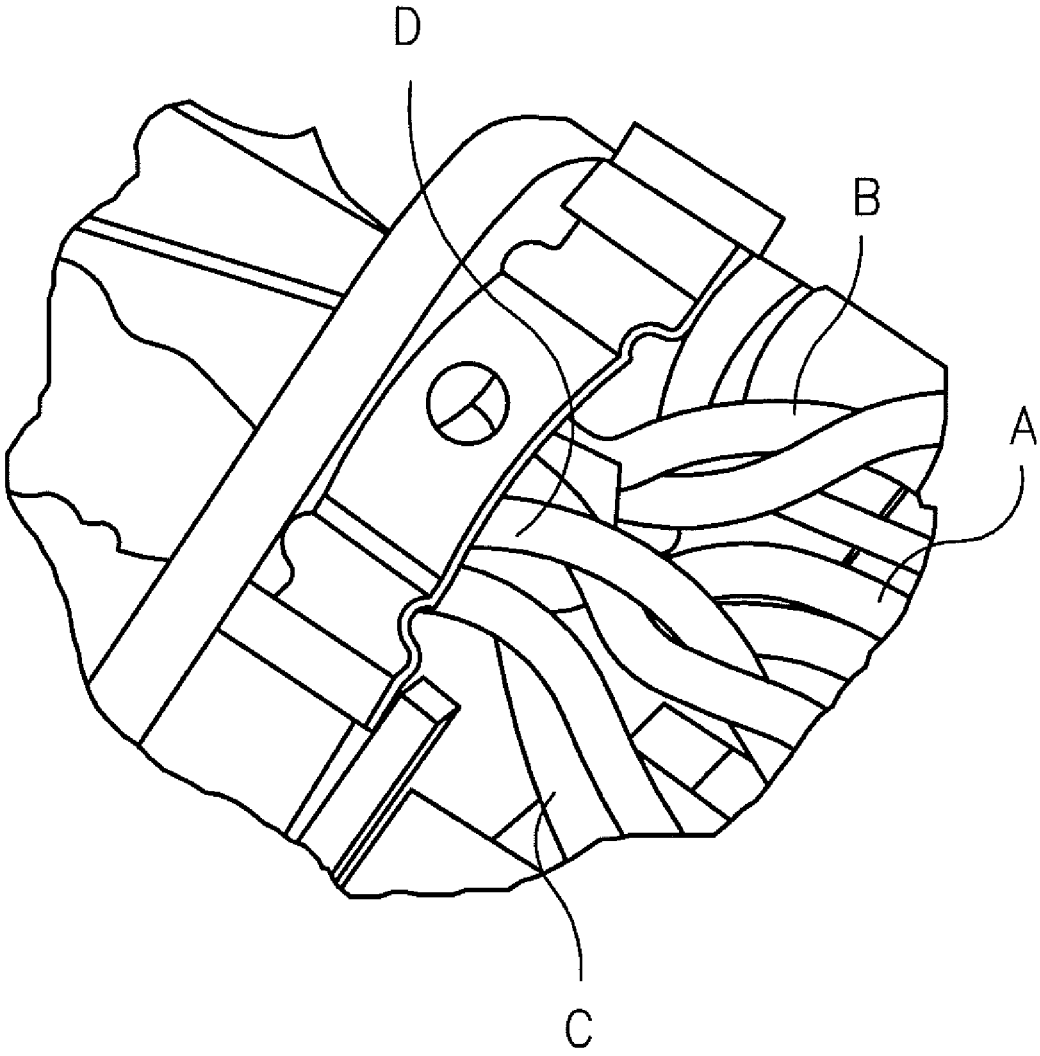
FIG. 4C is a detailed view of the lacing of wires in FIG. 4B.

FIG. 4C is a detailed view of the lacing of wires in FIG. 4B. FIG. 4C depicts the twisted pairs of wires A, B, C and D existing the cable in their natural lay positioned without crossing each other. As is shown in FIG. 4C, the wire pairs do not cross each other at the point of exit from the cable jacket or any point along their length to the termination bar.

Figure 4D:
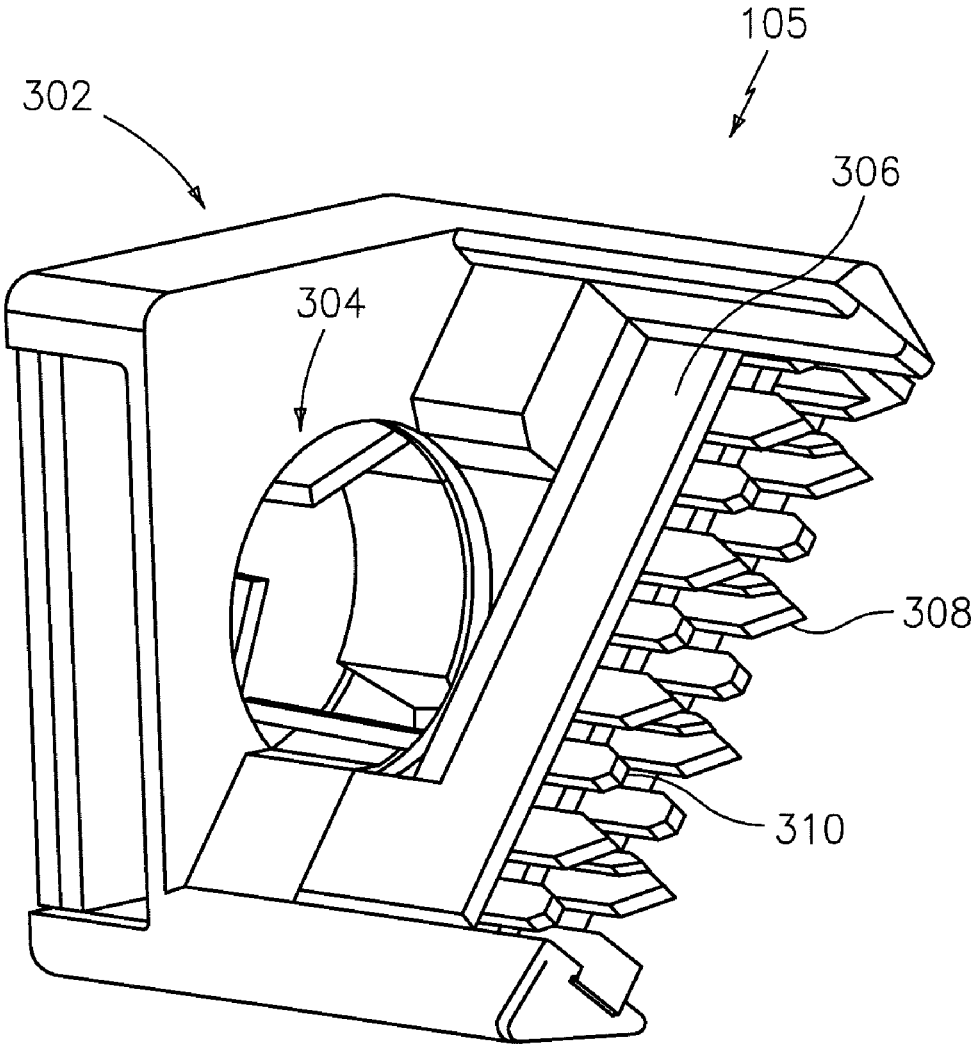
FIG. 4D is a perspective view of a termination block.

FIG. 4D is a perspective view of the termination block 105. Termination block 105 includes a base 302 having an opening 304 formed therein for receiving cable 107. The base 302 is rectangular. A termination bar 306 is supported above the base 302 and extends along the diagonal of base 302. The termination bar 306 includes a number of teeth 308 for separating wire pairs into individual wires. Slots 310 in the termination bar 306 retain the wires, which are then terminated in termination contacts 104.

This wiring technique, maintains the natural wire location of the wire pairs upon being laced in the termination block, eliminating the need for a crossover on either side of the cable. This eliminates the need for judgment and variances during installation, which lead to variation in performance characteristics. This results in higher performing systems, with reduced installation time, and higher first pass yield.

Embodiments of the invention allow the wire pairs to be terminated on the device from either end without crossing over a pair or having to split a pair. The connector contacts 104 may have non-standard profiles to increase performance and maximize space. The wire pairs stay in their natural position, or "lay", all the way into termination.

Figure 5A:
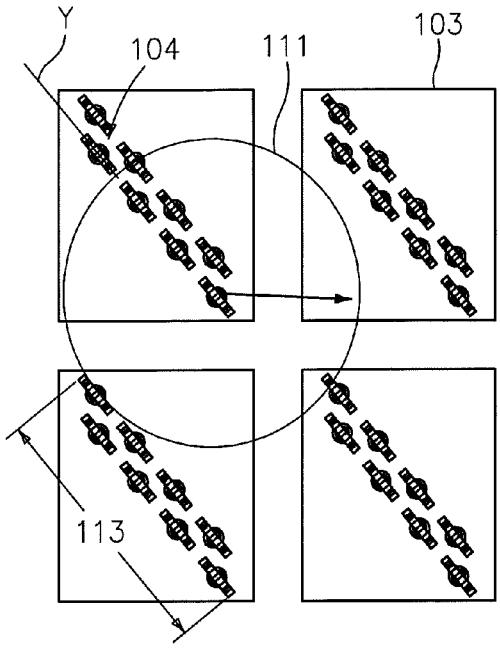
FIG. 5A illustrates termination contacts mounted on a substrate.
Figure 5B:
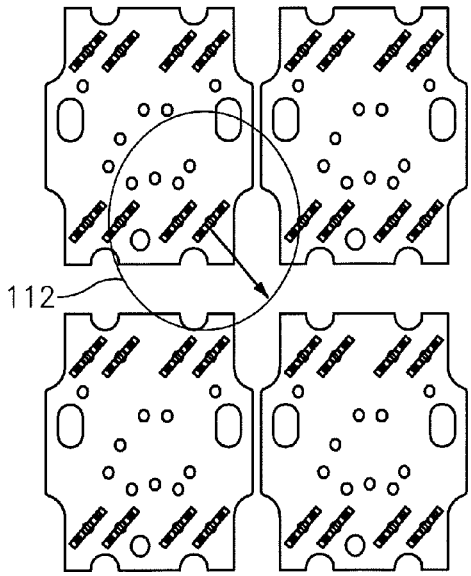
FIG. 5B (PRIOR ART)
FIG. 5B illustrates conventional termination contacts.
Figure 5C:
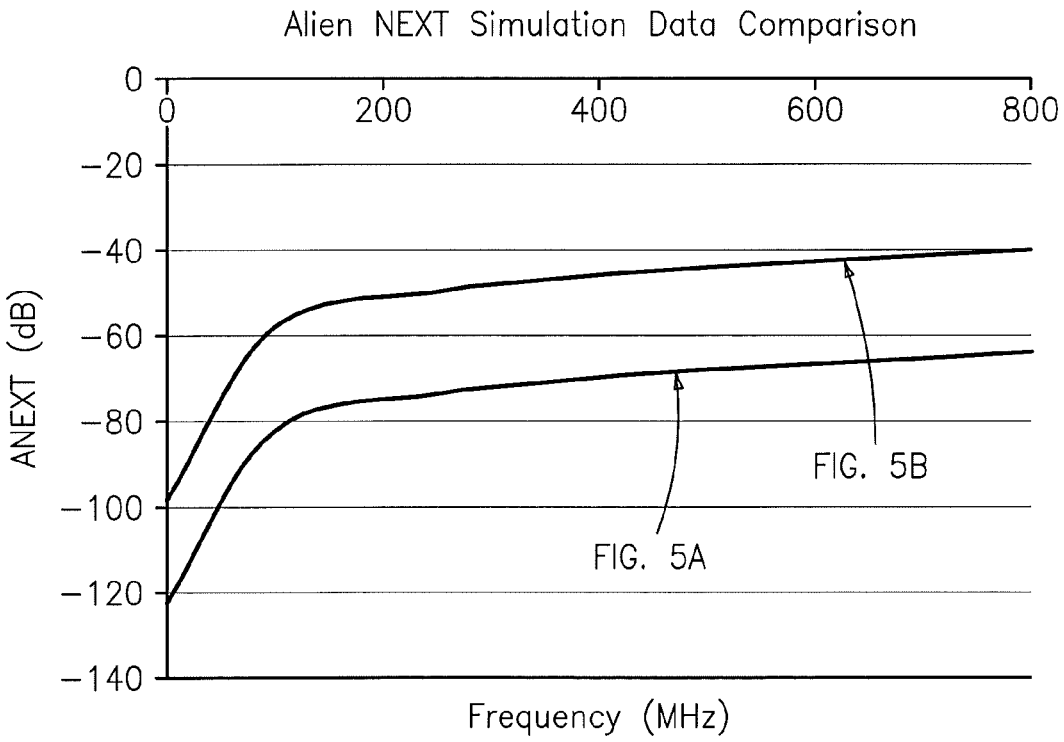
FIG. 5C is a plot of Alien NEXT for the embodiments of FIGS. 5A and 5B.

FIG. 5A illustrates the termination contacts 104 arranged on substrates 103, in an application where multiple connectors are mounted in proximity to each other (e.g., in a patch panel). The termination contacts 104 are arranged on a diagonal of substrate 103. This location maintains a maximized distance 111 from one connector to a neighboring connector, both on the sides and above or below a connector. This is a substantial improvement over existing designs as shown in FIG. 5B, where the distance between contacts is represented by area 112. It has been proven that maximizing this distance is an efficient method in reducing alien crosstalk. This method also effectively provides the largest area 113 for termination of wires. As transmission speeds increase, conductor sizes continue to grow, making it difficult to work with conventionally small connectors. Inversely, customers continually wish to fit more connectors in a given amount of space. The embodiments of this disclosure resolve both issues at the same time. FIG. 5C illustrates Alien Next versus frequency for the embodiments of FIGS. 5A and 5B.

Figure 6:
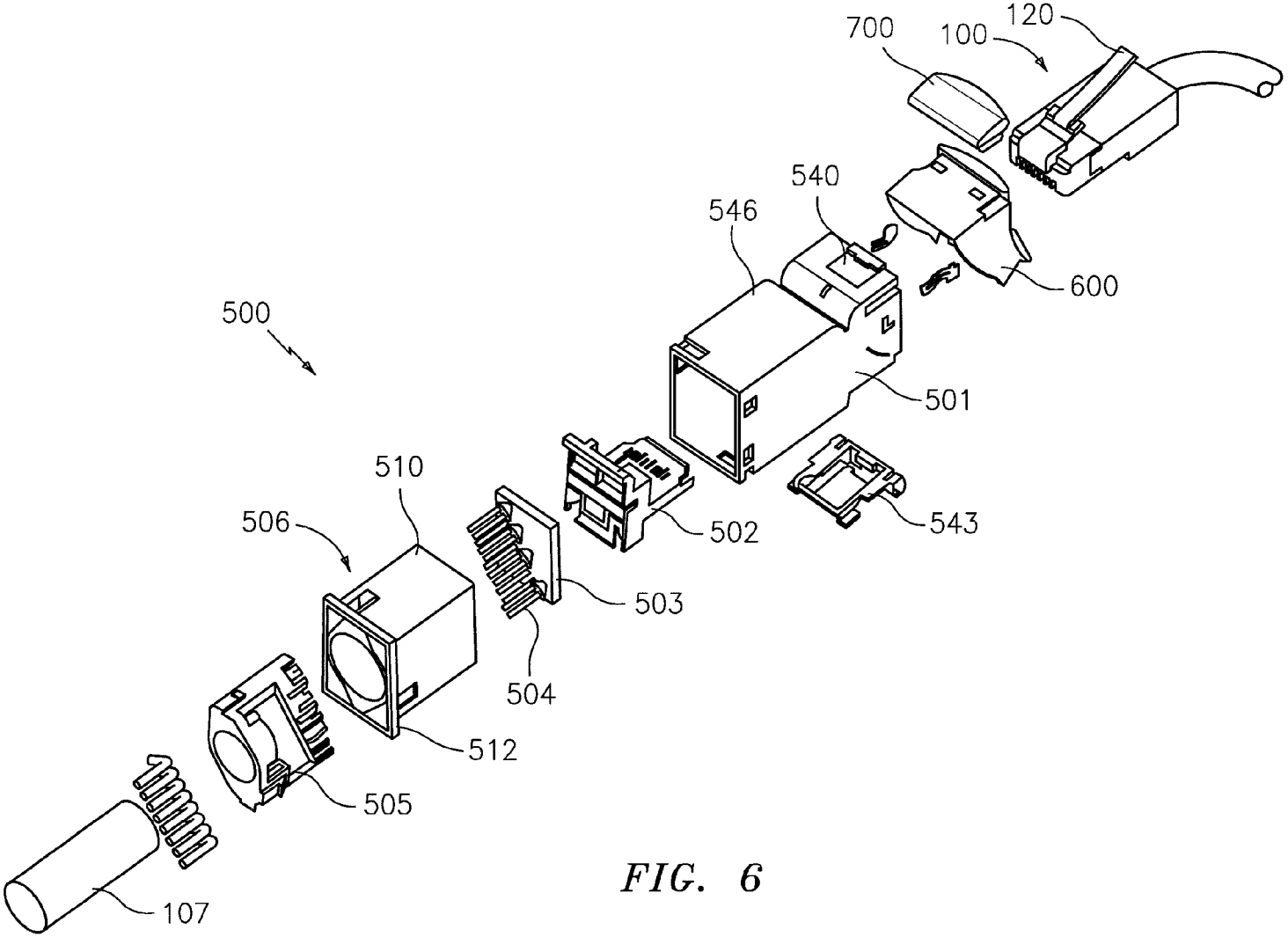
FIG. 6 is an exploded view of an exemplary connector in alternate embodiments of the invention.

FIG. 6 is an exploded view of an exemplary connector 500 in alternate embodiments of the invention. Connector housing 501 contains a number of components. A contact carrier 502 engages the connector housing 501. The contact carrier 502 includes connector contacts for making electrical contact with plug contacts in the plug on patch cord 100. The connector contacts may be wire form, flexible circuit material, etc. A substrate 503 establishes an electrical connection between connector contacts on the contact carrier 502 and termination contacts 504. Termination contacts 504 (e.g., insulation displacement contacts) are positioned to engage wires laced in the termination block 505 as described in further detail herein. The substrate 503 may be a printed circuit board, flexible circuit material, etc. having traces therein for establishing electrical connection between the contacts in the contact carrier 502 and termination contacts 504. As described in further detail herein, the substrate 503 may include compensation elements for tuning electrical performance of the connector (e.g., NEXT, FEXT). In alternate embodiments, the contact carrier 502 contacts and termination contacts 504 are part of a lead frame, eliminating the need for substrate 503. Connector housing 501 may be conductive to provide shielding. A termination guide 506 facilitates the termination block 505, laced with wires from cable 107, engaging the termination contacts 504. The interior surface of the termination guide 506 guides the external surface of the termination block 505. A bezel 600 is removably mounted to the connector housing 501 and also receives an icon 700. The bezel 600 and icon 700 are described in further detail herein.

The termination guide 506 includes a first end 510 that receives the termination contacts 504 on the substrate 503. The termination guide 506 includes structure to support the termination contacts 504 when wires from cable 107 are terminated to the termination contacts 504. The second end 512 of the termination guide 506 includes an opening sized and shaped to receive the termination block 505. As described in more detail herein, wires from cable 107 are laced into the termination block 505. When the termination block 505 is pushed into the termination guide 506, the wires laced in the termination block 505 engage the termination contacts 504 to drive the wires into the termination contacts and establish electrical connection.

Figure 6A:
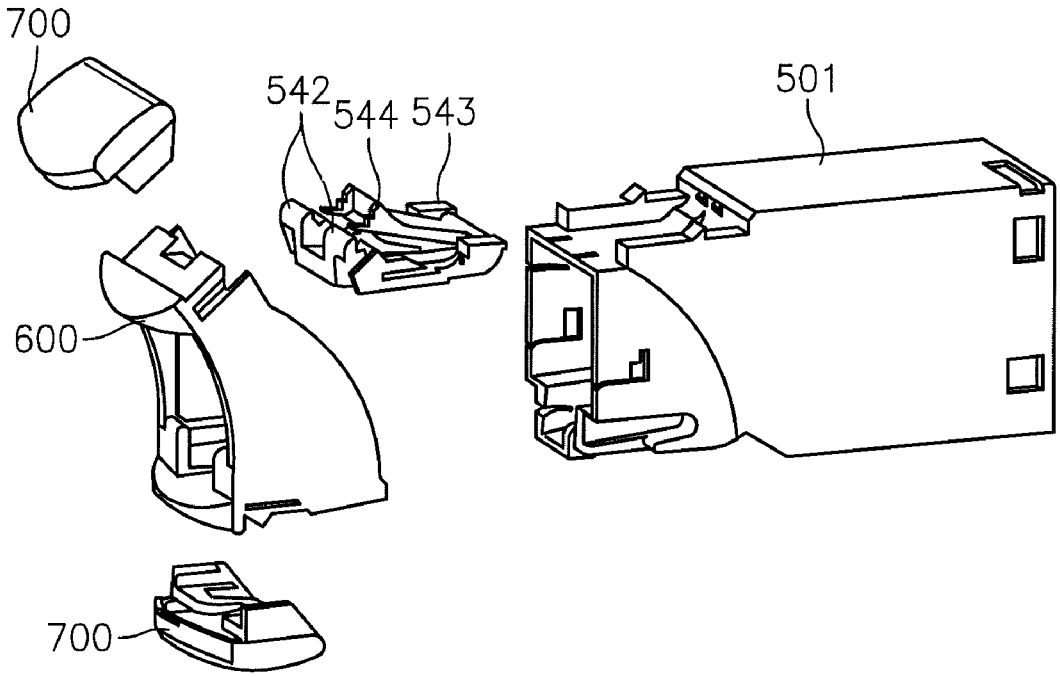
FIG. 6A is an exploded view of components in FIG. 6.

A latching assembly 543 is attached to the connector housing 501 to aid in securing the connector housing to a panel opening. FIG. 6A illustrates the latching assembly 543, which includes latch arms 542 a housing latch 544 positioned between the latch arms 542. The latch assembly 543 snaps onto the connector housing 501 in a recess provided on connector housing 501. The operation of the latch arms 542 and the housing latch 54 is described herein in further detail with reference to FIGS. 14-17.

Figure 7:
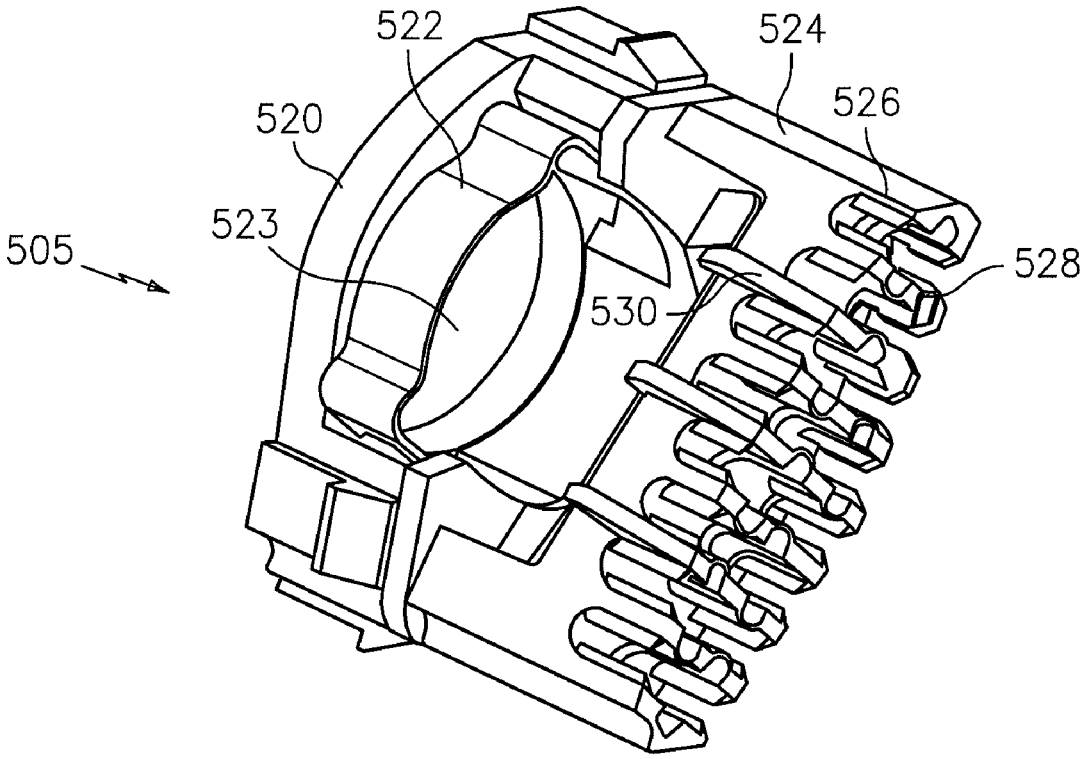
FIG. 7 illustrates a termination block in an exemplary embodiment.

FIG. 7 illustrates a termination block 505 in an exemplary embodiment. Termination block 505 includes a base 520 having an opening 523 formed therein for receiving cable 107. The base 520 may be conductive (e.g., made of metal, die cast, metallized plastic) so that the shield of cable 107 can be placed in electrical contact with the base 520, and the base 520 is placed in electrical contact with the connector housing 501. In shielded versions, the connector housing 501 is conductive. A resilient clip 522 is positioned in base 520 and is made from a conductive material (e.g., metal). When cable 107 is installed in termination block 505, the shield on the cable is folded back (as known in the art) and clip 522 is depressed to engage the exposed shield. This physical connection with the cable shield also establishes an electrical connection between base 520 and the cable shield, and provides strain relief for cable 107.

A termination bar 524 is supported above the base 520 and extends along the longitudinal axis of base 520. The termination bar 524 includes a number of teeth 526 for separating wire pairs into individual wires. Slots 528 in the termination bar 526 retain the wires, which are then terminated in termination contacts 504. Fins 530 extend away from the termination bar 524 and help to organize wire pairs by separating adjacent pairs of twisted wires.

Figure 8:
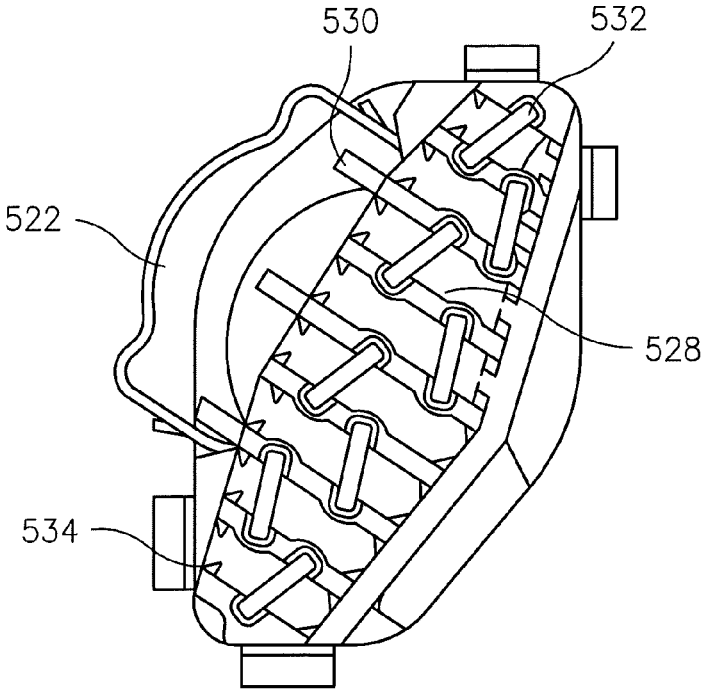
FIG. 8 illustrates the termination block of FIG. 7.
Figure 9:
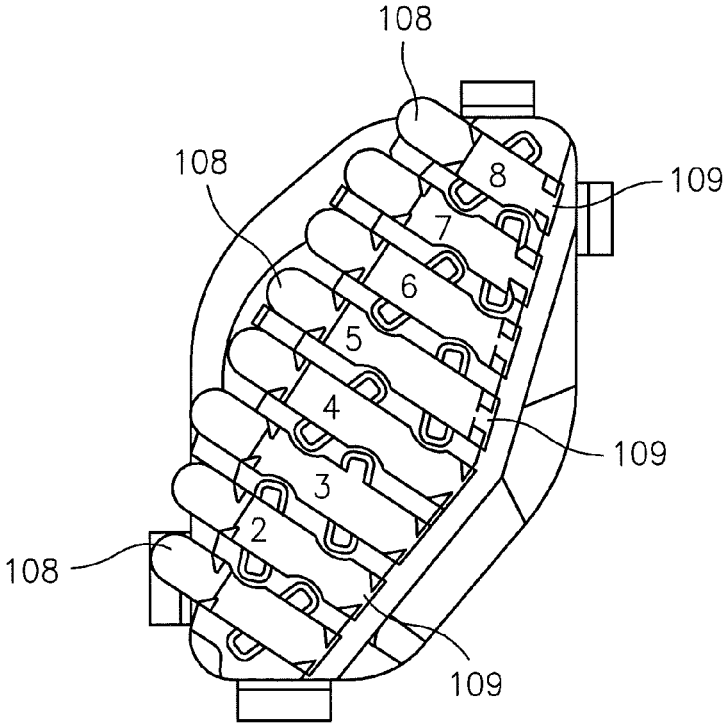
FIG. 9 illustrates the termination block of FIG. 7 laced with wires.

FIG. 8 illustrates the termination block of FIG. 7. Visible in FIG. 8 are openings 532 that receive the termination contacts 504. Slots 528 receive wires 108 (FIG. 9) and include barbs 534 formed on the interior walls of slots 528 to retain wires 108 in slots 528. The wires 108 are laced into termination bar 524 as shown in FIG. 9. In the embodiment of FIG. 9, all the wires 108 enter slots 528 from the same side of the termination bar. The positioning of wires in termination bar 524 is similar to that in termination bar 306 in that the wiring technique maintains the natural wire location of the wire pairs, eliminating the need for a crossover on either side of the cable. This eliminates the need for judgment and variances from the installers, which lead to variation in performance characteristics. This results in higher performing systems, with reduced installation time, and higher first pass yield. The termination block 505 of FIGS. 7-9 also eliminates crossing of wire pairs on both ends of cable 107, in a manner similar to that discussed above with reference to termination block 105. The wire pairs stay in their natural position, or "lay", all the way into termination.

As known in the art, the wires in cable 107 are arranged in twisted pairs including a tip conductor and a ring conductor. In FIG. 9, conductors 1 and 2 are a pair, conductors 3 and 4 are a pair, conductors 5 and 6 are a pair and conductors 7 and 8 are a pair. Each pair is separated from an adjacent pair by fin 530, which aids in separating the pairs of cable 107.

Also apparent in FIG. 9 is that the ends 109 of wires 108 are arranged along a common surface, that tapers towards the ends of the termination block 505. This allows the ends of the wires 108 to be trimmed with a single cutting tool in a single operation. This greatly facilitates installation and results in the ends 109 of the wires 108 being trimmed close to the surface of the termination bar 524. This reduces the negative effect of wires extending for any unnecessary length beyond the termination bar 524, as the wire stubs extending beyond the termination bar 524 will act as antenna points for radiating crosstalk.

Figure 9A:
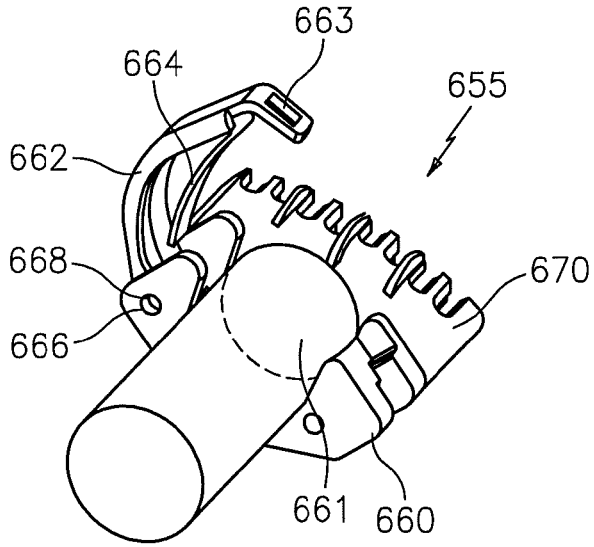
FIG. 9A illustrates a termination block with a ground latch in exemplary embodiments.

FIG. 9A illustrates a termination block with a ground latch in exemplary embodiments. Termination block 655 includes a base 660 similar to base 520 in FIG. 7, except that base 660 includes a latch arm 662 pivotally mounted to the base 660. The pivoting latch arm 662 provides access to a cable recess 661 in base 660. An opening 666 is formed in the base 660 and the latch arm 662 is hingedly mounted to base 660 through a pin 668 mounted in opening 666. The arm 662 includes a spring clip 664, which is resilient. The base 660, arm 662 and spring clip 664 are conductive (e.g., made from metal). A termination bar 670 is similar to termination bar 524 and includes teeth and slots for lacing wires into the termination block as described above.

Figure 9B:
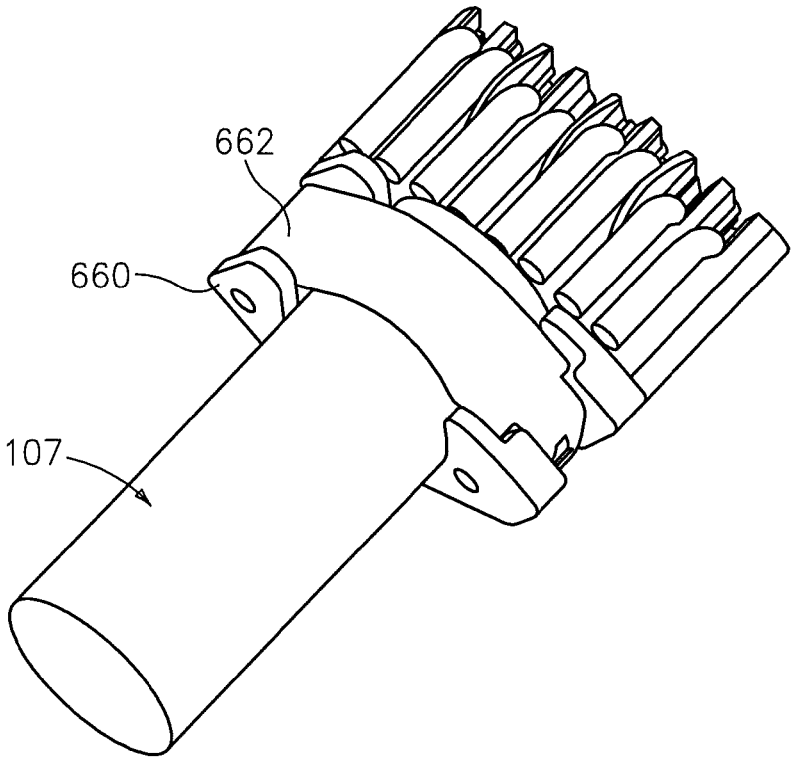
FIG. 9B illustrates the termination block of FIG. 9A with a cable installed.

FIG. 9B illustrates the termination block of FIG. 9A with a cable installed. The arm 662 and spring clip 664 allow electrical contact to be made with a shield of cable 107. In FIG. 9B, the foil shield of cable 107 is folded back around the cable jacket as known in the art. The cable 107 is placed in cable recess 661 such that the cable shield is in physical and electrical contact with base 660. Latch arm 662 is closed to cover recess 661 so that spring clip 664 contacts the cable shield to establish physical and electrical contact with the cable shield. An opening 663 on the distal end of the latch 662 engages a catch on the base 660 to lock the arm into place. As described above with reference to FIG. 7, the conductive base 660 makes electrical contact with the connector housing 501 in embodiments where the connector housing 501 is shielded.

The embodiment of FIGS. 9A and 9B allows cables 107 having differing outer diameters to be used with the termination block 655. The spring clip 664 is resilient and thus can accommodate larger cable diameters while still making electrical contact with smaller cable diameters. This allows the size and form factor of termination block 655 and connector housing 501 to be constant, regardless of the cable 107 diameter. Further, arm 662 has a single closed position greatly facilitating installation of cable 107 in the termination block 655. This allows a user to deterministically affix the cable 107 to the termination block 655. The arm 662 and spring clip 664 apply sufficient pressure to cable 107 to provide strain relief as well.

Figure 10:
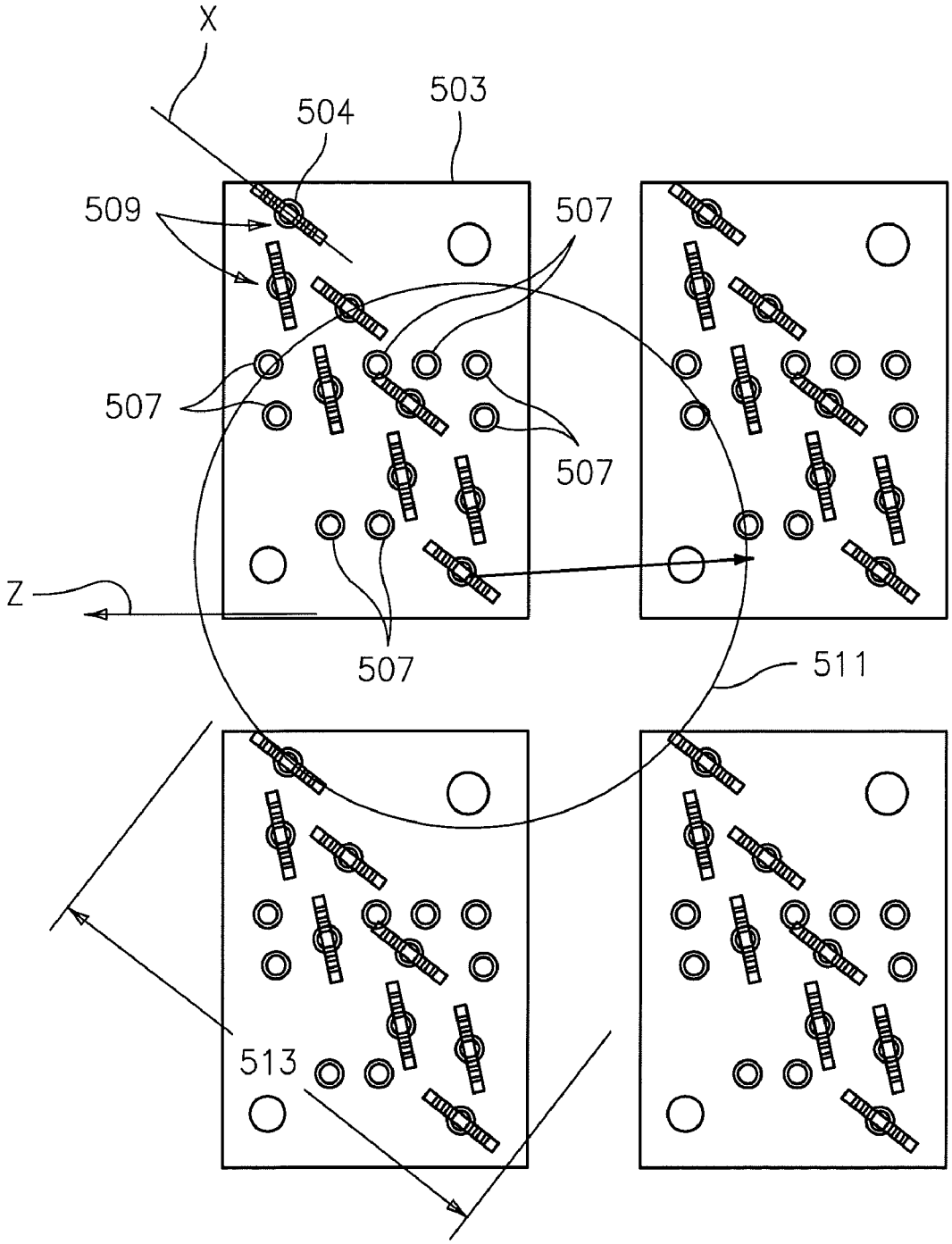
FIG. 10 illustrates an arrangement of termination contacts in an exemplary embodiment.
Figure 11:
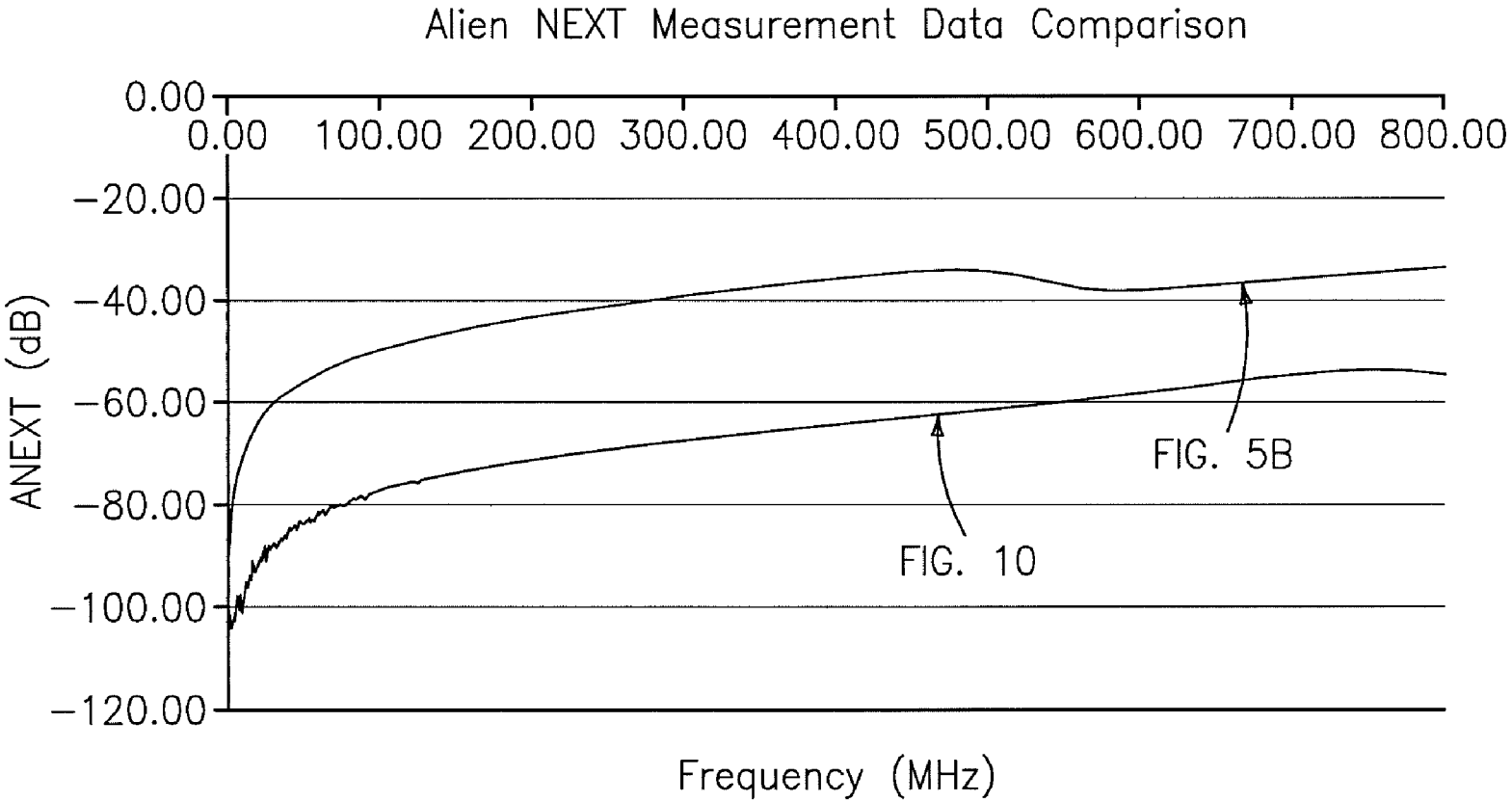
FIG. 11 is a plot of Alien NEXT for the embodiments of FIG. 10 and the prior art.

FIG. 10 illustrates an arrangement of termination contacts in an exemplary embodiment. FIG. 10 illustrates termination contacts 504 arranged on substrates 503, in an application where multiple connectors are mounted in proximity to each other (e.g., in a patch panel). The termination contacts 504 are arranged on a diagonal of substrate 503. This location maintains a maximized distance 511 from one connector to a neighboring connector, both on the sides and above or below a connector. This is a substantial improvement over existing designs, as shown in FIG. 5B, where the distance between contacts is represented by area 112. It has been proven that maximizing this distance is an efficient method in reducing alien crosstalk. This method also effectively provides the largest area 513 for termination of wires. FIG. 11 illustrates Alien Next versus frequency for the embodiments of FIGS. 10 and 5B.

Also evident in FIG. 10 is the arrangement to the termination contacts 504 with respect to plated through holes 507 on substrate 503. Plated through holes 507 receive ends of the connector contacts 800 (FIG. 26) that are supported on contact carrier 502. Plated through holes 507 are generally located in a central area of substrate 503. Termination contacts 504 are mounted in a second set of plated though holes 509 located in substrate 503 at the base of each termination contact 504. As shown in FIG. 10, through holes 509 for termination contacts 504 intersect the area on substrate 503 containing plated through holes 507. This results in a number of benefits. First, the distance between termination contact 504 and a plated through hole 507 is short, thus only a short trace is needed on substrate 503 to electrically connect a termination contact 504 with a respective plated through hole 507. This ability to have short electrical paths, minimizes electrical delay, resulting in improved high frequency transmission properties. Further, this arrangement allows the longest dimension on substrate 503 (i.e., the diagonal) to be used in spacing the termination contacts 504.

By intersecting the termination contacts 504 and connector contacts 800, the plated through holes, and associated components can be arranged to provide coupling (or de-coupling) to compensate the near end crosstalk and far end crosstalk of the outlet. This compensation can be achieved by positioning and arranging the components instead of using long circuit board traces which can negatively affect high frequency transmission performance of the outlet assembly.

It is also apparent in FIG. 10 that a lateral axis X of each termination contact 504 varies with reference to an axis of the substrate. The lateral axis X extends through the prongs forming the IDC portion of termination contact 504 and is parallel to the substrate 503. In FIG. 5A, the lateral axis Y of termination contacts 104 is consistent for each termination contact 104. In other words, with respect to a reference axis in the plane of substrate 103 (e.g., longitudinal, lateral, diagonal), the angle between the reference axis and the lateral axis for each termination contact 104 is equal. This is not the case in FIG. 10. The angle of lateral axis X of the termination contacts 504 with respect to a reference axis in the plane of substrate 503 (e.g., longitudinal, lateral, diagonal) varies among the termination contacts 504. As shown in FIG. 10, the lateral axis X of each termination contact 504 is arranged at one of two different angles with respect to a reference axis Z.

By manipulating the angles of the termination contacts 504, components can couple (or de-couple) appropriately, while minimizing negative effects of unbalanced coupling. The different angles of the termination contacts 504 can help improve the balance characteristics of the associated pairs. Providing greater coupling between the tip and ring of one pair (e.g., contacts 1 and 2) results in a pair that creates less radiation, as the differential pair is not disturbed as greatly as seen in prior art. This will result in greater balance, improved crosstalk, improved alien crosstalk, and improved return loss.

By angling the termination contacts 504 with opposing angles, unbalanced crosstalk between pairs can be drastically minimized. When crosstalk is present, it is undesirable to have unbalanced compensation (i.e., coupling pins 3 and 5 without coupling 4 and 6). Angling the termination contacts 504 can greatly help avoid unbalanced compensation that can occur on designs with straight pins (i.e., FIG. 5A). Unbalanced compensation results in poor balance, and in turn, poor high frequency transmission performance for other parameters (i.e. NEXT, ANEXT).

Figure 12:
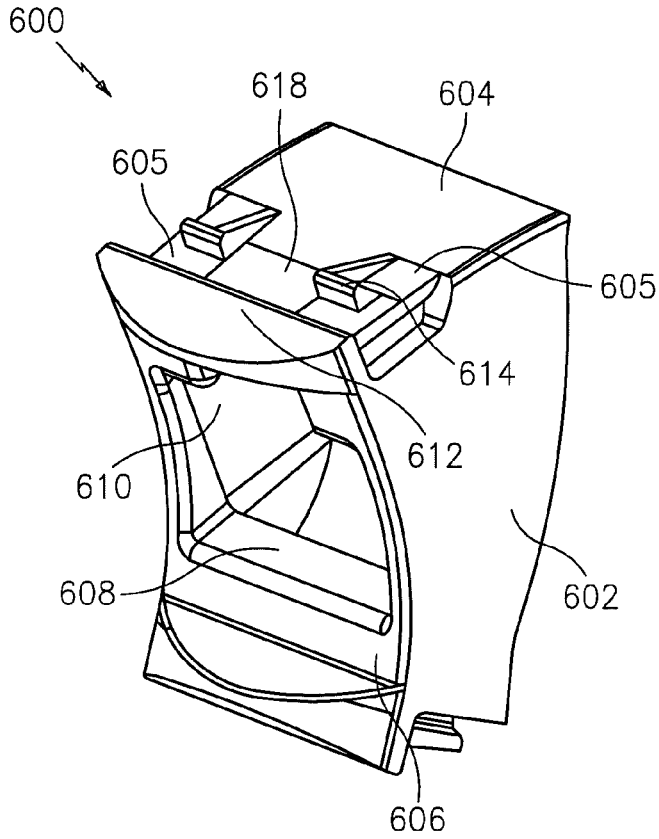
FIG. 12 is a front, perspective view of a bezel in exemplary embodiments.
Figure 13:
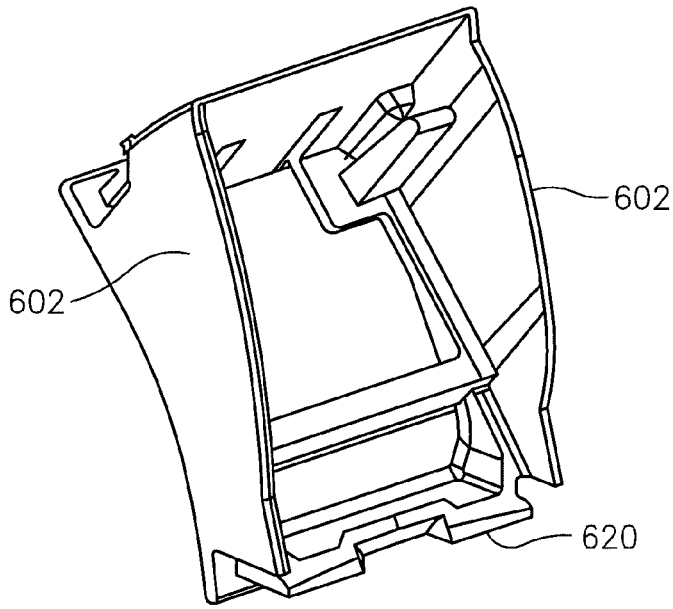
FIG. 13 is a rear, perspective view of the bezel of FIG. 12.

FIG. 12 is a front, perspective view of a bezel 600 in exemplary embodiments. Bezel 600 includes two sidewalls 602, a first end wall 604 and a second end wall 606. Bezel 600 includes a front face having an opening 608 for receiving plug 100, with a recess 610 for receiving plug latch 120. First end wall 604 includes a raised, front lip 612 that runs parallel to the front face of bezel 600. A pair of raised projections 614 are distanced from the lip 612. The lip 612 and the projections 614 define a groove there between for receiving an edge of a faceplate opening. A forward facing latch 618 is positioned between the projections and is a cantilevered latch used to secure the bezel to the connector housing 501 at opening 540. Recesses 605 are formed at the junctions of the side walls 602 and first end wall 604. Recesses 605 receive extensions 704 on icon 700 as described herein. FIG. 13 is a rear, perspective view of the bezel of FIG. 12. The second end wall 606 includes a pair of projections 620 similar to projections 614.

Figure 14:
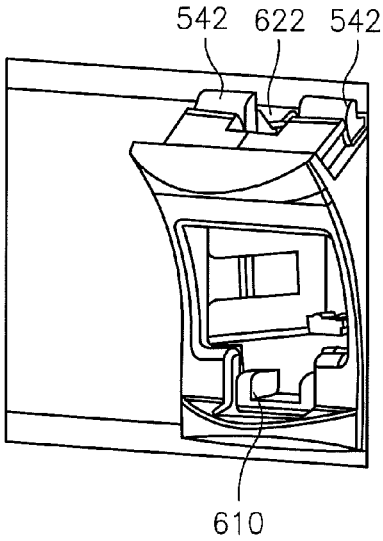
FIG. 14 is a front, perspective view of a connector mounted in a panel in a flat configuration using the bezel of FIG. 12.
Figure 15:
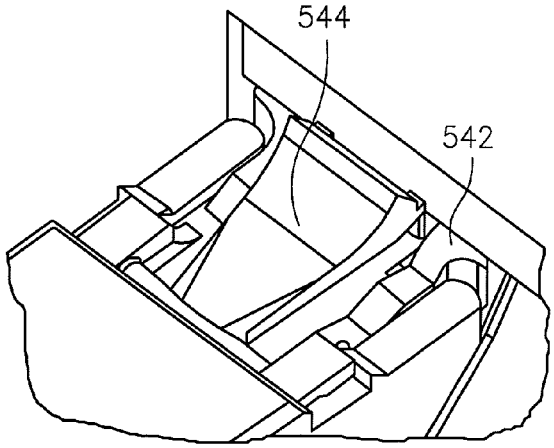
FIG. 15 is a rear, perspective view of a connector mounted in a panel in a flat configuration using the bezel of FIG. 12.

FIG. 14 is a front, perspective view of a connector mounted in a panel in a flat configuration using the bezel of FIG. 12. Bezel 600 is secured to connector housing 501 so that latch 618 engages an opening 540 in the connector housing 501. In the flat configuration, the lower edge of the faceplate opening is positioned between lip 612 and projections 614. The upper edge of the faceplate opening is positioned between latch arms 542 of the latching assembly 543 and latch 544 of the latching assembly 543. In the flat configuration, the recess 610 and plug latch 120 are facing downwards, or in the direction of gravity. This is a preferred orientation for outlets as the outlet contacts in contact carrier 502 are in an upward position preventing contaminants from collecting on the outlet contacts. FIG. 15 is a rear, perspective view of the connector mounted in a panel in a flat configuration using the bezel of FIG. 12 showing housing latch 544 abutting the rear side of the upper edge of the faceplate opening.

Figure 16:
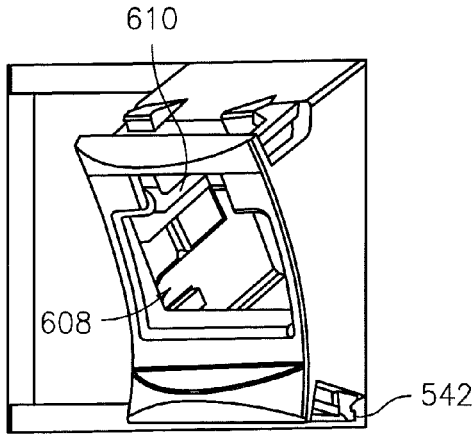
FIG. 16 is a front, perspective view of a connector mounted in a panel in an angled configuration using the bezel of FIG. 12.
Figure 17:
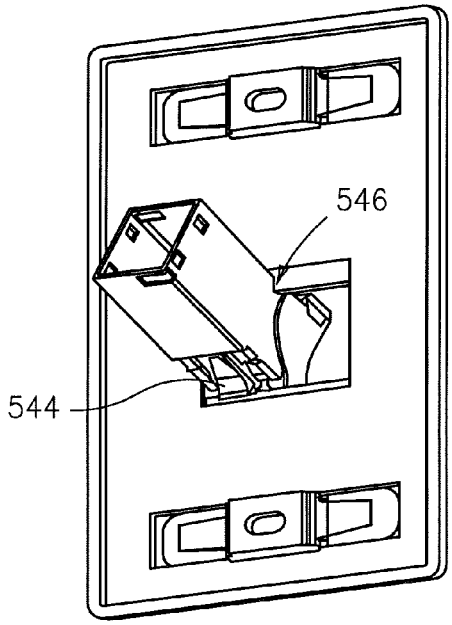
FIG. 17 is a rear, perspective view of a connector mounted in a panel in an angled configuration using the bezel of FIG. 12.

FIG. 16 is a front, perspective view of a connector mounted in a panel in an angled configuration using the bezel of FIG. 12. Angled in this context refers to the opening 608 in bezel 600 being angled downward at an oblique angle relative to the front face of the faceplate. In this configuration, the bezel 600 is connected to the connector housing 501 in the same orientation as FIGS. 14 and 15. The unit is rotated 180 degrees relative to that of FIGS. 14 and 15 such that the recess 610 for receiving plug latch 120 is upward, opposite the direction of gravity. This greatly facilitates access to plug latch 120 when the connector 500 is mounted in the angled orientation. In this angled configuration, projections 620 abut the front side of the bottom edge of the opening in faceplate. Housing latch 544 abuts against the rear side of the bottom edge of the faceplate opening to locate connector 500. The backside of the upper edge of the faceplate opening is positioned in a groove 546 formed in the connector housing 501. A rear end of the first end wall 604 abuts against the front side of the upper edge of the faceplate opening. FIG. 17 is a rear, perspective view of a connector mounted in a panel in an angled configuration using the bezel of FIG. 12 showing housing latch 544 and groove 546.

The bezel 600 allows color-coding of connectors, including connectors having a shielded (e.g., metal) connector housing 501. Shielded connectors and unshielded connectors will have a similar appearance once mounted in a faceplate, yielding a cleaner final installation. In manufacturing the connector 500, the bezel 600 allows for configuring color-coded outlet at the end of an assembly process. Existing connectors color-code the entire connector housing, rather than color-code a bezel. This complicates the manufacturing process and stocking requirements for such designs. Bezel 600 also provides for mounting a connector in either an angled or flat configuration in a standard faceplate opening, the faceplate opening being sized according to IEC standards.

Figure 18:
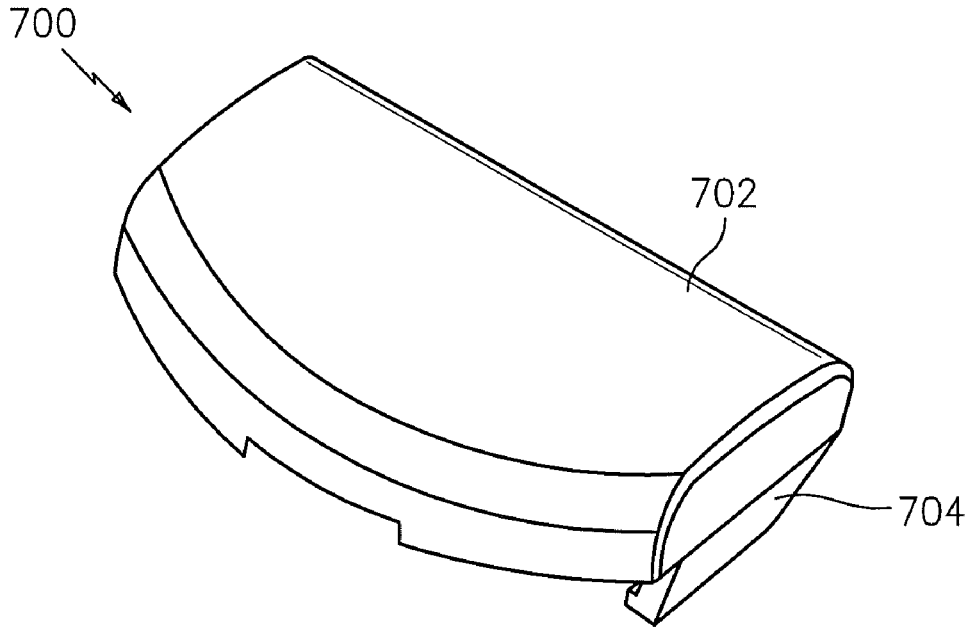
FIG. 18 is a front, perspective view of an icon in exemplary embodiments.
Figure 19:
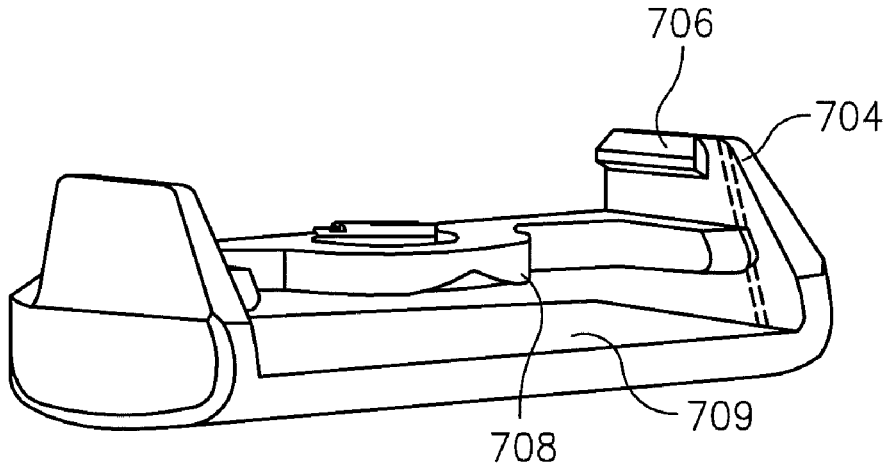
FIG. 19 is a rear, perspective view of the icon of FIG. 18.

FIG. 18 is a front, perspective view of an icon in exemplary embodiments. Icon 700 has a body 702 with resilient extensions 704 extending away from the body 702. As described with reference to FIG. 20, the extensions 704 include catches 706 that engage recesses in the bezel sidewalls 602 to secure the icon 700 to the bezel 600. FIG. 19 is a rear, perspective view of the icon of FIG. 18. As shown in FIG. 19, the back surface of the icon 700 includes an arm 708 distanced from the back surface of the icon body 702. This gap between the icon body 702 and the arm 708 defines a pocket 709 to receive an insert (e.g., a paper element) used to identify the connector associated with the icon 700. The insert may be color coded to indicate the type of connector (e.g., voice or data). Additionally, the insert may include indicia in the form of a pictorial representation of the type of connector (e.g., image of a phone or computer). One advantage of the icon 700 is that the insert may be placed in the icon 700 before the icon is mounted on bezel 600. The icon body 702 is made from a transparent material such that the insert can be viewed through the icon. The icon body 702 may also be contoured (e.g., concave, convex) to define a lens to provide magnification of text/indicia on an insert. In alternate embodiments, the icon 700 is made a solid, opaque color and the color alone designates the type of connector.

Figure 20:
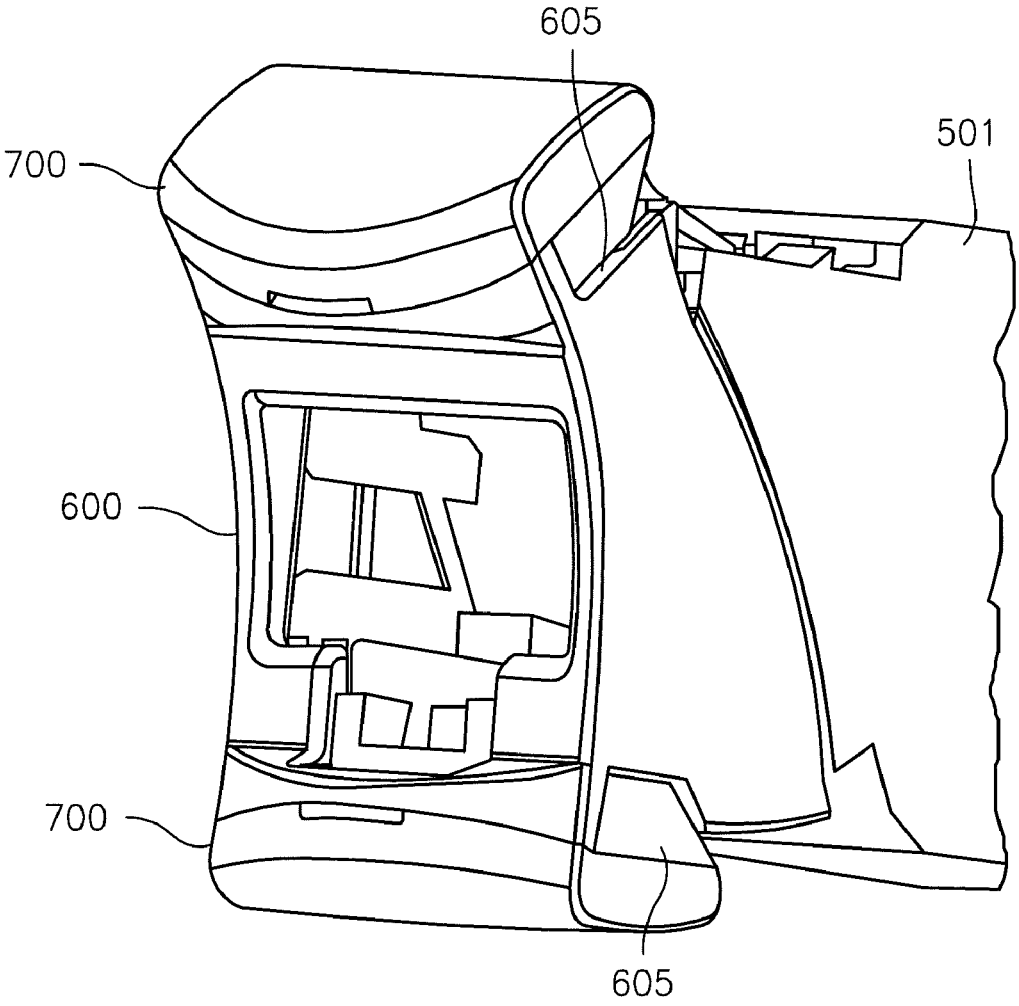
FIG. 20 is a perspective view of the bezel mounted to a connector housing and icons mounted to the bezel.

FIG. 20 is a perspective view of bezel 600 mounted on a connector housing, fitted with two icons 700. FIG. 20 shows the extensions 704 engaging recesses 605 in sidewalls 602 of the bezel 600. It is noted that two icons 700 are not typically mounted to the bezel 600 in use. Icon 700 is mounted to first endwall 604 when the connector is mounted in the angled orientation of FIGS. 16 and 17. Icon 700 is mounted to second endwall 606 when the connector is mounted in the flat orientation of FIGS. 14 and 15.

Figure 22:
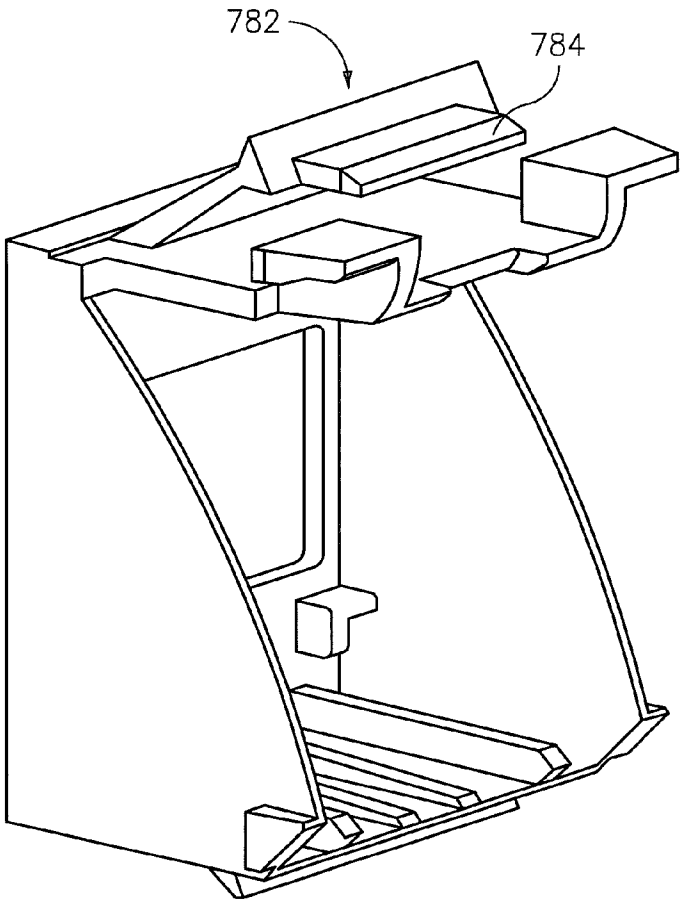
FIG. 22 is a rear, perspective view of the keystone bezel of FIG. 17.
Figure 21:
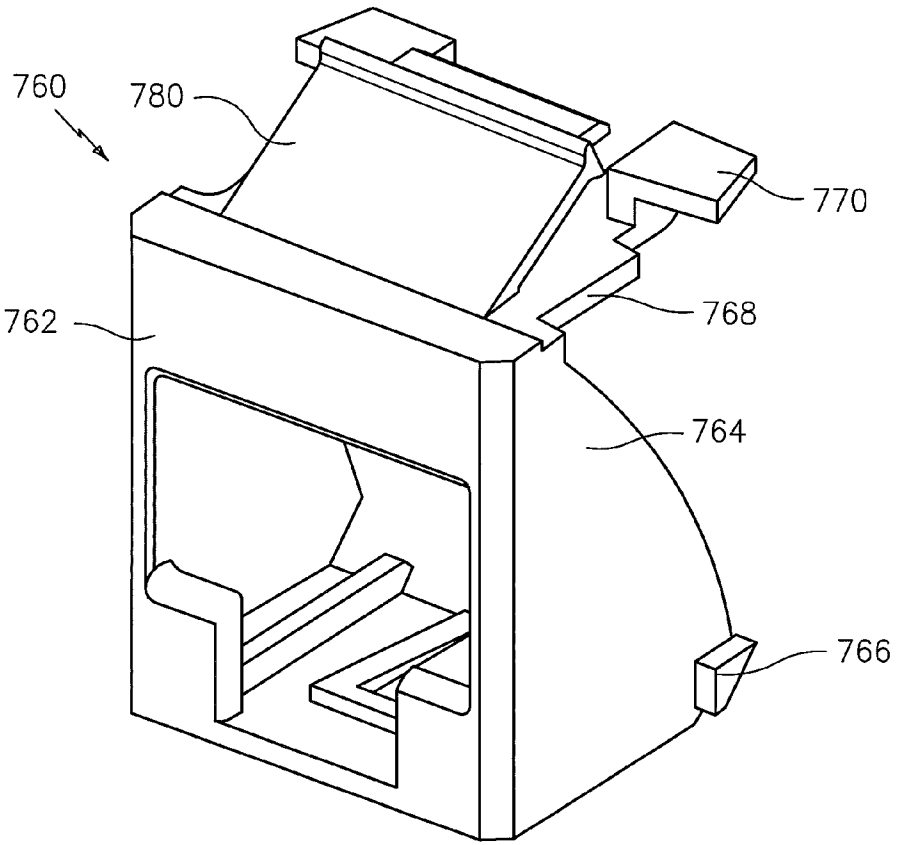
FIG. 21 is a front, perspective view of a keystone bezel in exemplary embodiments.

FIG. 21 is a front, perspective view of a keystone bezel 760 in exemplary embodiments used to mount connector 500 in keystone applications (e.g., faceplates with keystone openings that may meet IEC standard dimensions). The keystone bezel 760 latches onto the connector housing 501. Keystone bezel 760 includes front face having an opening for receiving plug 100. Sidewalls 764 extend rearward from the front face 762 and include stops 766 that abut the backside of a faceplate as shown in FIG. 24. A plate 768 extends back from the front face 762 and includes to nubs 770 that also abut the backside of a faceplate as shown in FIG. 24. A keystone latch 780 extends above plate 768 at an oblique angle heading away from the front face 762 so that the distal end of latch 780 is farthest from the front face 762. Keystone latch 780 includes a rib 782 parallel to the front face 762 and a catch 784, spaced apart from rib 782 at the distal end of keystone latch 780. FIG. 22 is a rear, perspective view of the keystone bezel of FIG. 17.

Keystone bezel 760 uses a keystone latch 780 that is reversed relative to existing latches on keystone connectors. In other words, existing keystone connectors have a latch extending towards the front face of the connector. The keystone bezel of FIGS. 21 and 22 includes a latch 780 extending away from the face of the connector. When mounted in a panel, latch 780 is in a compressive mode. Latch 780 is far easier to defeat than existing keystone latches.

Figure 23A:
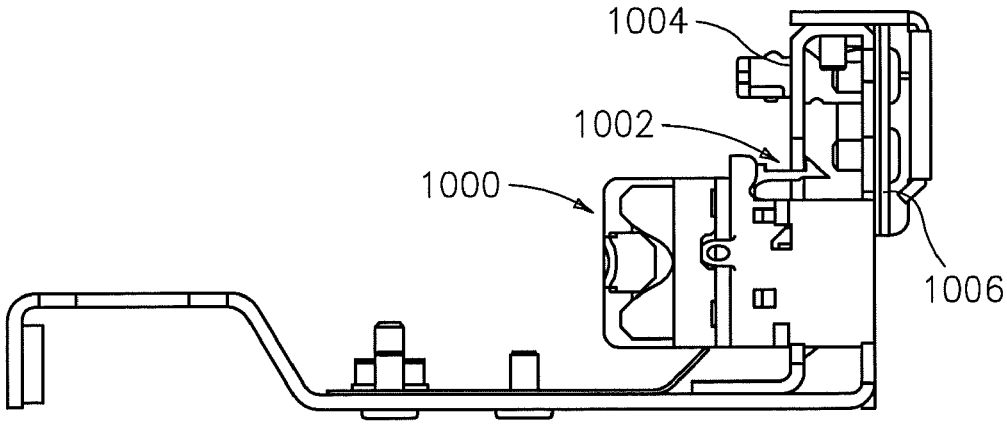
FIG. 23A (PRIOR ART)
FIG. 23A is a cross-sectional view of a conventional keystone connector mounted in a keystone faceplate.

FIG. 23A is a cross-sectional view of a conventional keystone connector mounted in a keystone faceplate. The typical installation for a keystone style connector is in a double walled faceplate having a rear wall 1004 and a front wall 1006. This results in the front face of the connector being flush with the front wall 1006. A conventional keystone connector 1000 is shown mounted in the panel with forward facing latch 1002 having a front lip behind rear wall 1004.

Figure 23B:
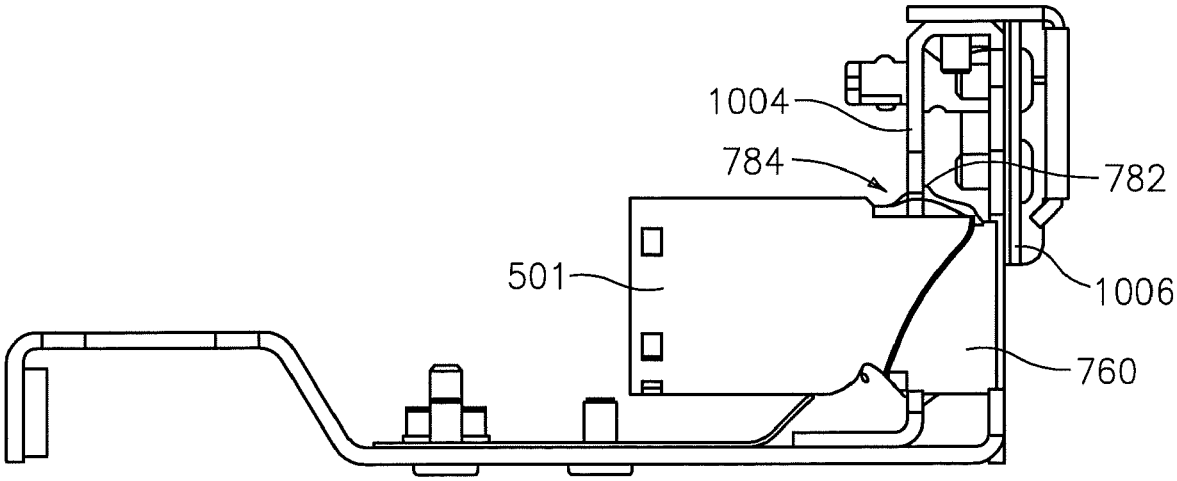
FIG. 23B is a cross-sectional view of a connector mounted in a keystone faceplate using the bezel of FIGS. 21 and 22.

FIG. 23B is a cross-sectional view of a connector mounted in a keystone faceplate using the bezel of FIGS. 21 and 22. Connector housing 501 is secured to bezel 760. As shown in FIG. 23B, the rib 782 is positioned between front wall 1006 and rear wall 1004. The catch 784 is exposed behind rear wall 1004 allowing a user to defeat the latch 780 by pressing downwards on catch 784. This is significantly easier the defeating latch 1002 as substantial pressure is needed to deflect latch 1002 as the user is not applying pressure near the distal end of the latch 1002.

Figure 24A:
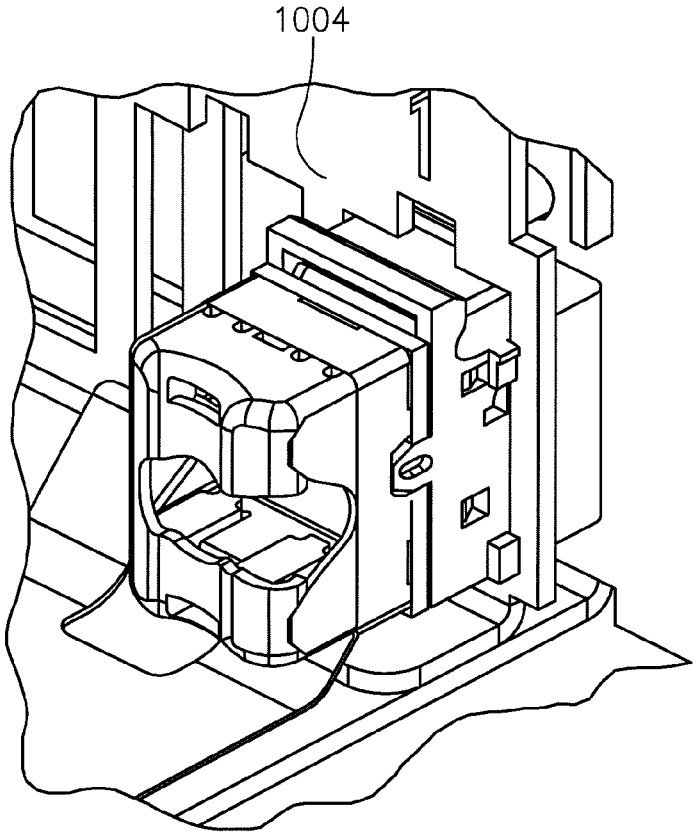
FIG. 24A (PRIOR ART)
FIG. 24A is a perspective view of a conventional keystone connector mounted in a keystone faceplate.
Figure 24B:
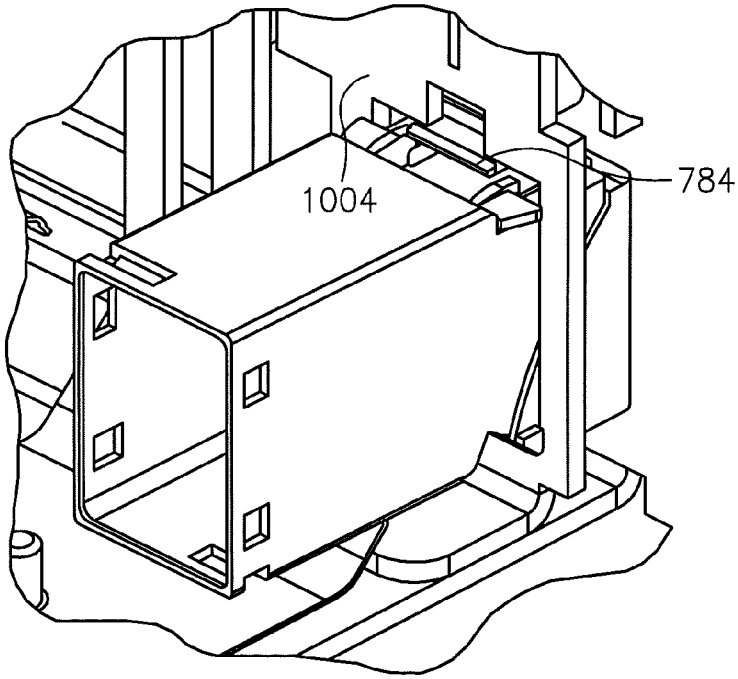
FIG. 24B is a perspective view of a connector mounted in a keystone faceplate using the bezel of FIGS. 21 and 22.

FIG. 24A is a perspective view of a conventional keystone connector mounted in a keystone faceplate. Latch 1002 passes under rear wall 1004. Because the latch 1002 is forward facing, substantial pressure is needed on latch 1002 to remove the connector 100 from the faceplate. FIG. 24B is a perspective view of a connector mounted in a keystone faceplate using the bezel of FIGS. 21 and 22. As shown in FIG. 24B, the rearward facing latch 780 results in catch 784 being exposed behind rear wall 1004. This allows a user to defeat latch 780 by pressing down on catch 784. Because the latch 780 is rearward facing, the user applies pressure to the distal end of latch 780 making it far easier to deflect than conventional keystone latches.

One aspect of embodiments of the invention is that the connector housing 501 can be fitted with either bezel 600 (for either angled or flat mounting) or bezel 760 for keystone applications. This allows a common connector housing 501 (and associated components) to be used for a variety of applications. The bezels 600 and 760 may be added in the field by an installer allowing the installer to easily customize connector installations. This also reduces complexity for the manufacture of the connector 500 as a common core connector is manufactured, with only different bezels needed to meet customer demand.

Figure 25:
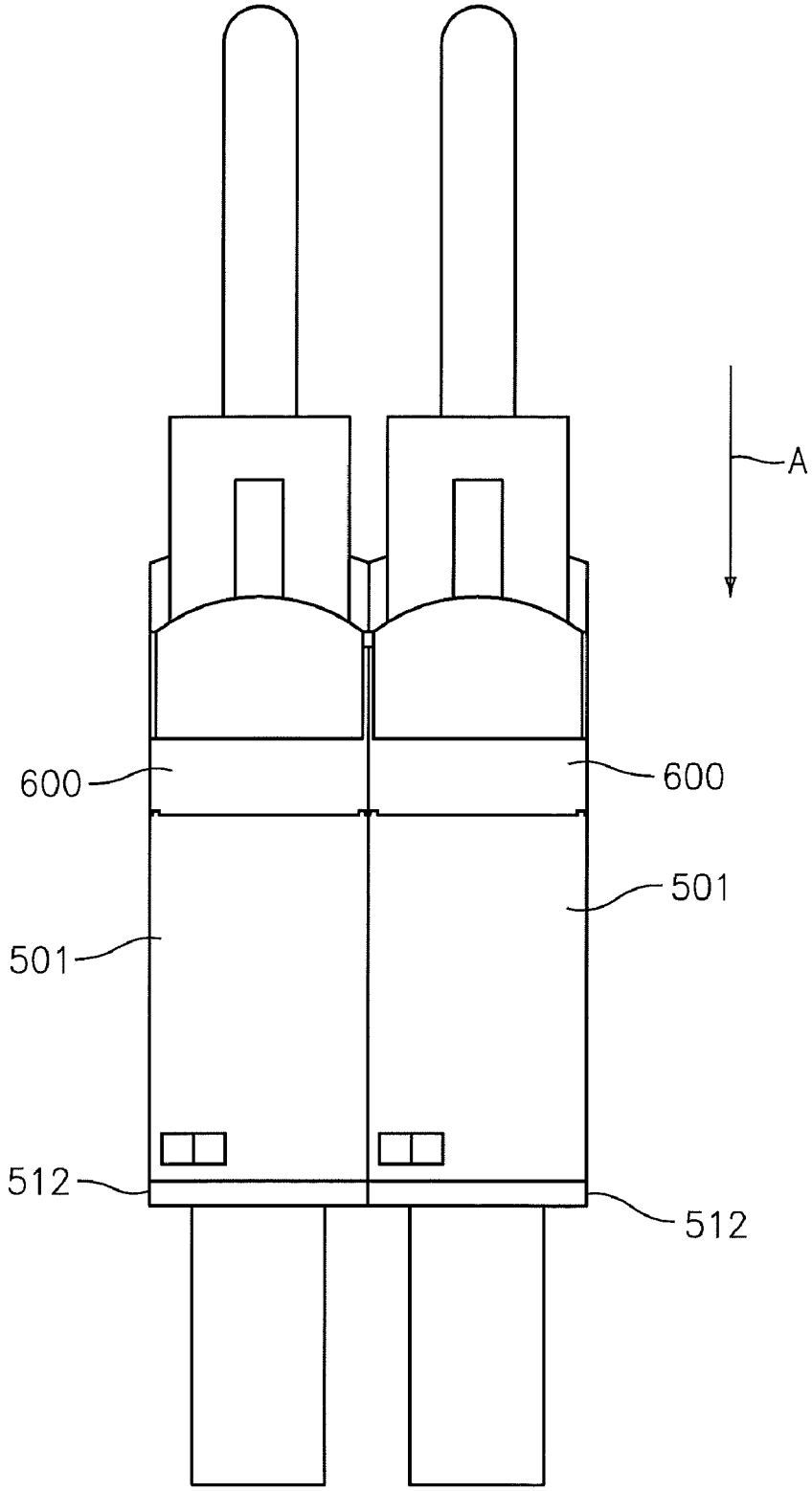
FIG. 25 illustrates two connectors of FIG. 6 mounted side-by-side.

FIG. 25 illustrates two connectors of FIG. 6 mounted side-by-side. FIG. 25 is a top view of the connectors. Each connector housing includes a top (visible in FIG. 25), a bottom, and two sidewalls. In embodiments of the invention, one of the bezel sidewalls 602 (FIG. 12) extends farther than the other sidewall in the direction indicated by arrow A (parallel to the direction that a plug is mated with connector 500) in FIG. 25. In other words, one sidewall 602 extends farther from the opening 608 in the bezel 600, in the direction that a plug mates with the connector. This results in the sidewall acting as a spacer between adjacent connector housings 501. If connector housings 501 are metal, then the interface between two adjacent connectors transitions from metal to plastic to metal. Similarly, one side of the second end 512 of the termination guide 506 includes a flange along the connector housing 501 side in a direction opposite arrow A. Again, the flange on the termination guide 506 is positioned between the two connector housings 501 and prevents adjacent connectors 500 from contacting each other. This is important in embodiments where the connector housing 501 is shielded and it is desirable to keep the shielded connectors electrically isolated. Extensions of the bezel sidewall 602 and the termination guide 506 control spacing between grounded connectors to maintain ground isolation electrically. This design provides consistent isolation between signal and chassis ground, which is a requirement for advanced high bandwidth applications such as Infiniband. As the extended sidewall of bezel 600 and flange on the termination guide 506 are integrated features, there is no way to inadvertently contact ground connections between two adjacent connectors. By biasing the spacing element (i.e., the extended sidewall) on one side, variability in how the bezel 600 or termination guide 506 engagers connector housing 501 does not interfere with the ability of the flange to effectively maintain a positive space between adjacent connectors.

Figure 26:
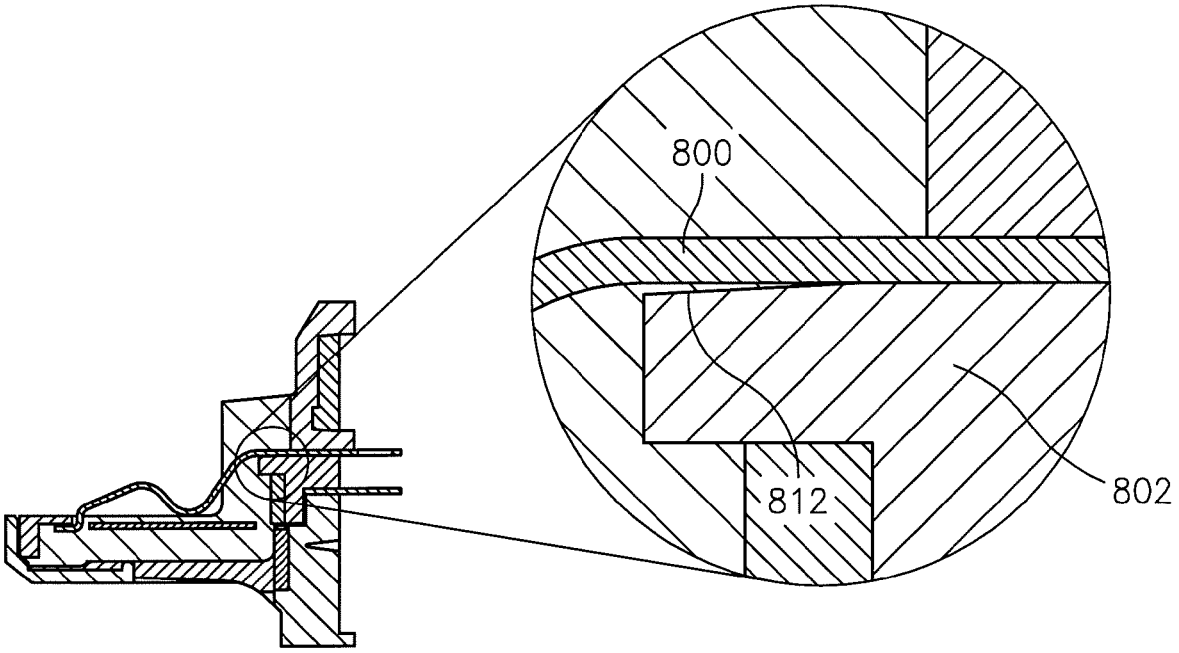
FIG. 26 illustrates a contact support in exemplary embodiments.

FIG. 26 illustrates a contact support in exemplary embodiments. As noted above, contact carrier 502 (FIG. 6) includes outlet contacts making electrical connection with plug contacts in plug 100. FIG. 26 illustrates an outlet contact 800 positioned on a contact support 810. It is understood that contact carrier 502 includes a plurality of outlet contacts (e.g., 4, 6, 8, 10) and a single contact 800 is shown for ease of illustration. When a plug is mated with connector 500, the contact 800 deflects downwards as the plug contact engages the outlet contact 800. The contact support section 810 includes an arcuate section 812 rather than being completely planar as conventional in the art. The arcuate section 812 beneath the contact 800 supports the contact 800 as the contact is deflected downwards in a manner to provide progressive constant radius support of the contact. Contact 800 acts as a cantilevered beam and the arcuate section 812 maximizes travel of the beam, while developing a uniform stress/strain profile on top and bottom of contact 800. By reducing stress and strain, a shorter length contact 800 may be used within a given working range. Additionally, reducing stress and strain allows the manufacturer to use more common and environmentally friendly material, such as phosphor bronze.

Figure 27:
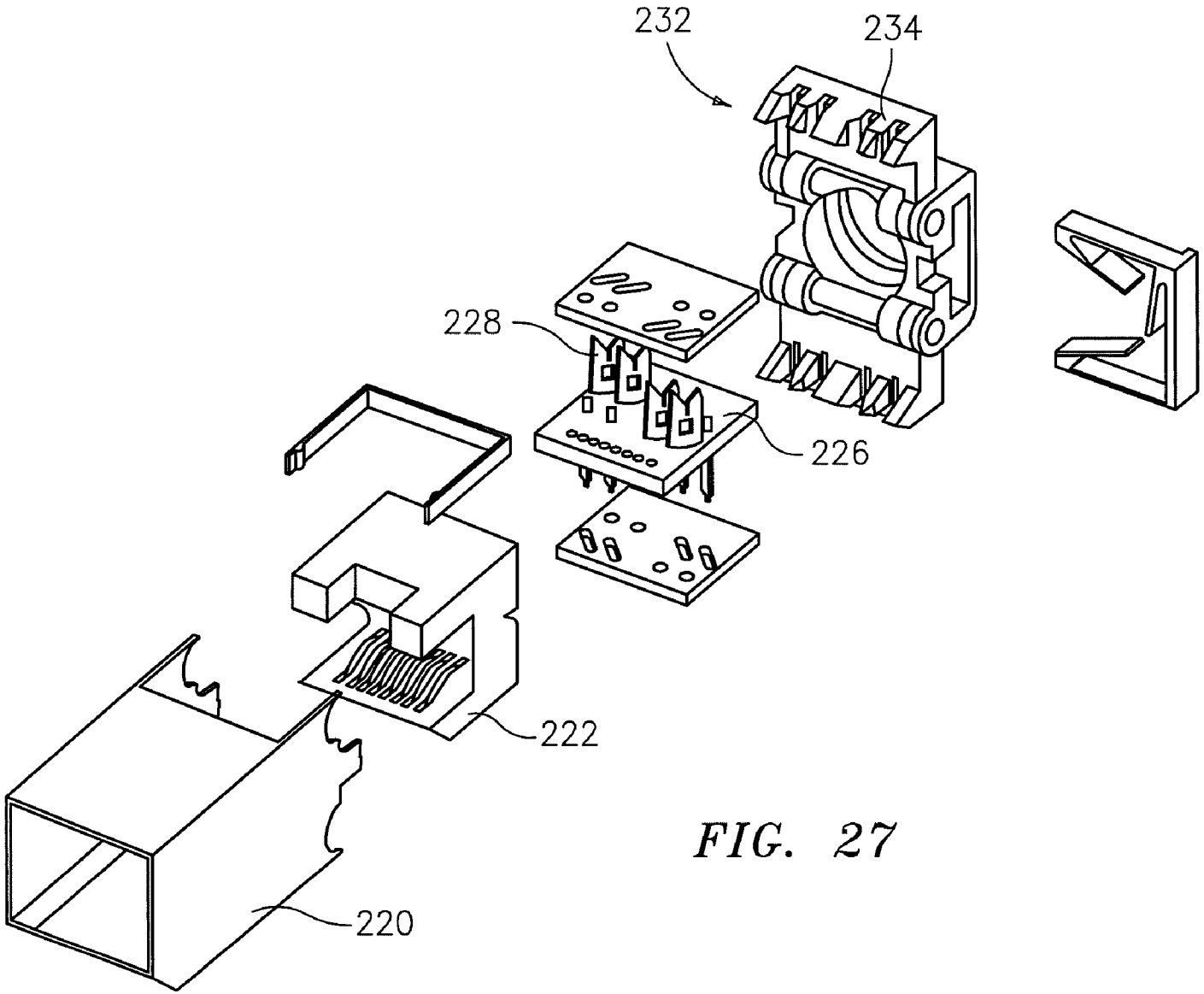
FIG. 27 is an exploded view of connector in an alternate embodiment.

FIG. 27 is an exploded view of an embodiment that maximizes alien crosstalk performance by utilizing both sides of the substrate for wire termination. Doing this allows a larger range of termination contact geometry while maximizing distance when connectors are mounted in close proximity. The embodiment of FIG. 6 includes a connector housing 220 that receives a contact carrier 222. Connector housing 220 may be conductive to provide shielding. A substrate 226 (e.g. a printed circuit board) receives termination contacts 228. Traces on substrate 226 electrically couple connector contacts in contact carrier 22 with the termination contacts 228.

Wires are terminated to the termination contacts 228 through a termination device having a termination body 232 and two termination caps 234 hingedly mounted to the termination body 232. The termination body 232 includes an opening for receiving cable 107. Wires 108 are aligned with termination contacts 228. The termination caps 234 are then rotated toward substrate 226 to force the wires into termination contacts 228 and make electrical contact therewith. Pairs of the termination contacts can be located forward or rearwards to increase the distance between adjacent termination contacts and maximize the space between these pairs within a connector and this improves crosstalk performance within the connector.

Figure 28:
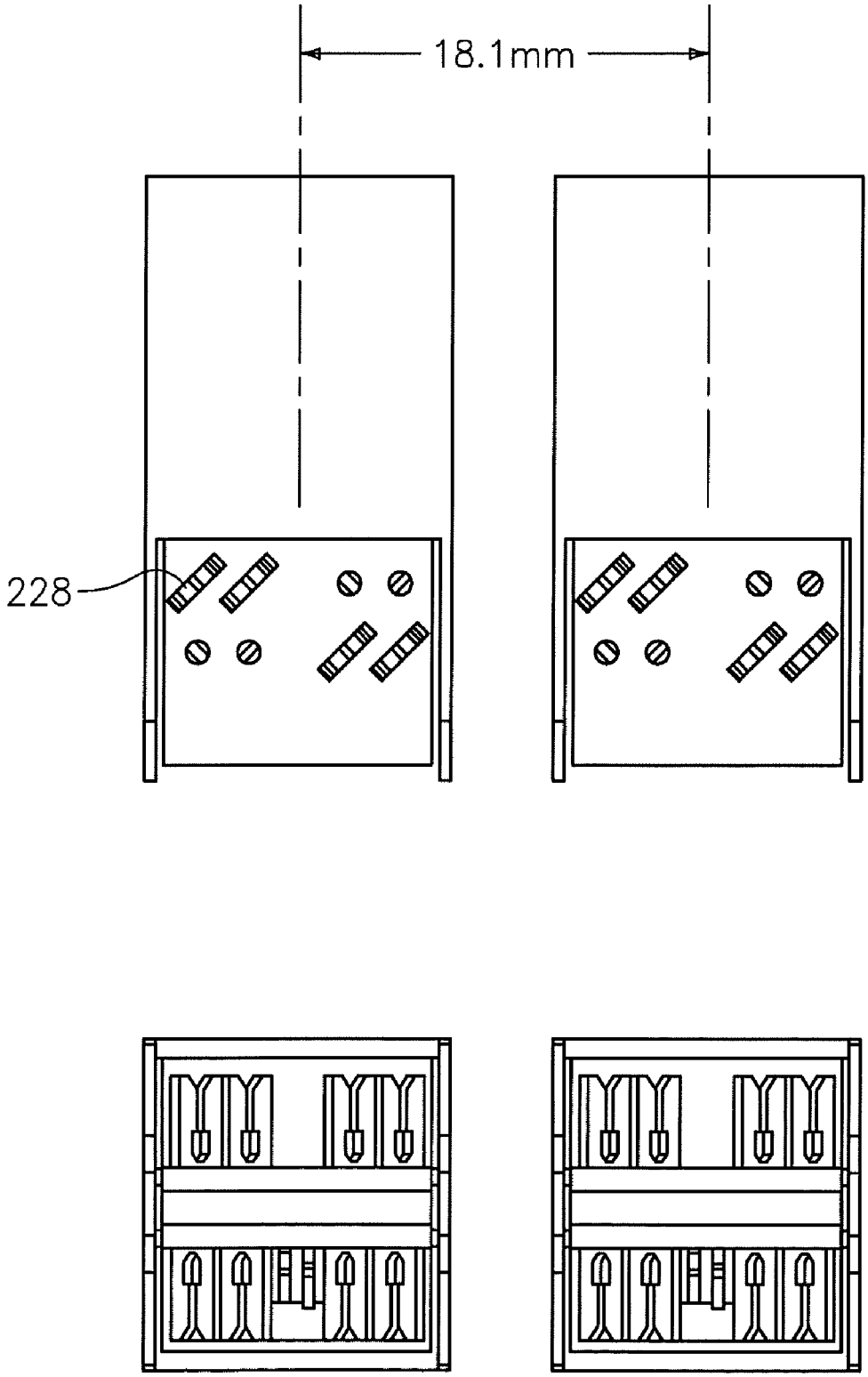
FIG. 28 illustrates two connectors of FIG. 27 mounted in close proximity.

FIG. 28 illustrates two modular connectors of FIG. 27 mounted side-by-side, such as in a patch panel. As shown in FIG. 28, the termination contacts 228 have an increased distance between adjacent termination contacts, as compared to prior art designs. Again, this reduces Alien Crosstalk (AN-EXT) by increasing the distance between adjacent contacts.

Figure 29:
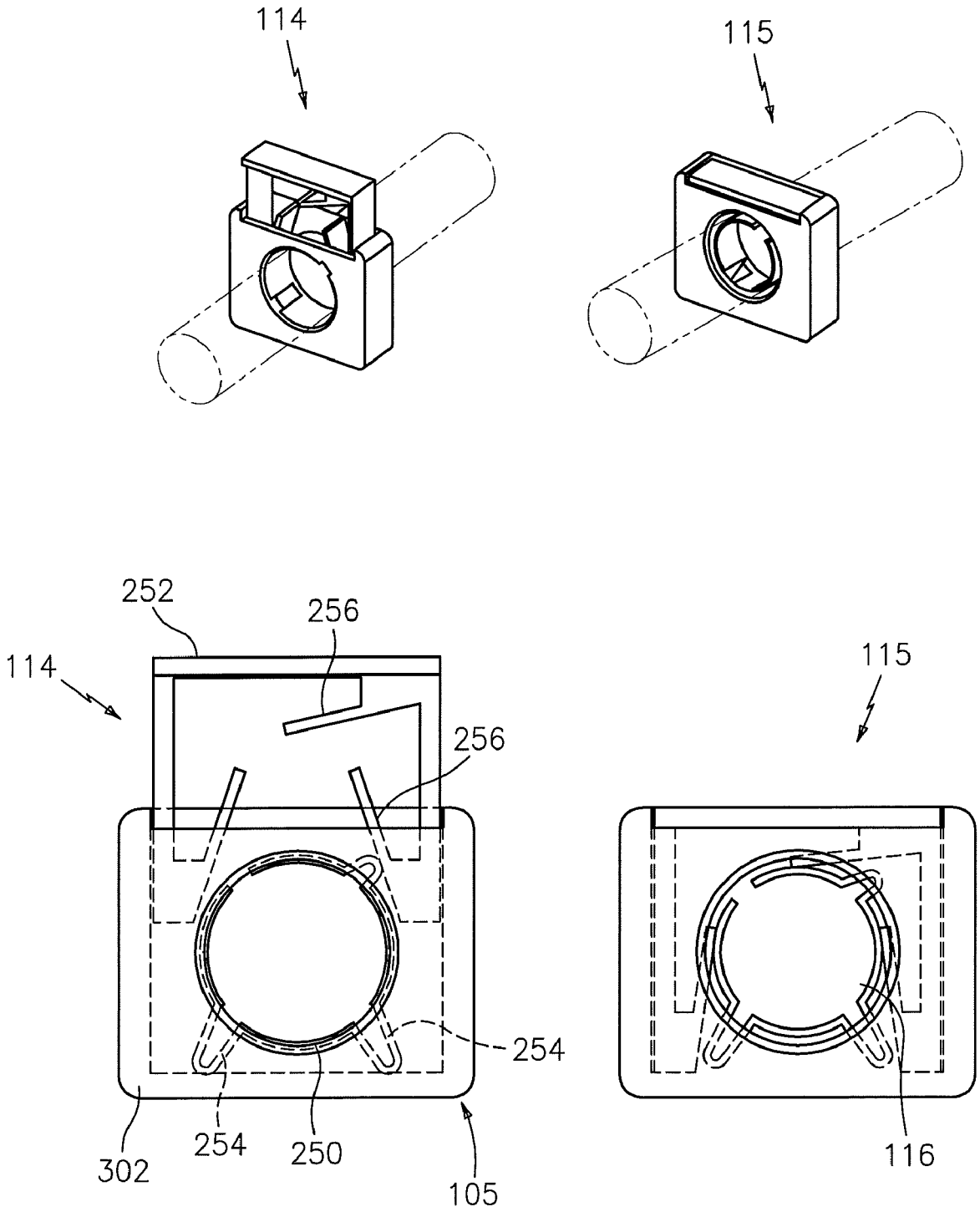
FIG. 29 is an illustration of a strain relief and shield termination assembly.

FIG. 29 illustrates the strain relief and shield termination assembly in an un-engaged 114 and engaged 115 positions. The strain relief and shield termination assembly includes a strain relief clip 250 and an activator 252. The stain relief clip 250 is conductive and generally circular having a plurality of spring member sections 254 formed therein. The strain relief clip 250 is positioned in the base 302 of termination block 105. Actuator 252 is generally rectangular, and has one open end for receiving the strain relief clip 250. The interior surfaces of the actuator 252 include tabs 256 for contacting the strain relief clip 250. When tabs 256 contact the strain relief clip 250, the strain relief clip 250 is driven radially inward to secure onto cable 107. The gripping of the cable provides strain relief for the modular connector. Further, if cable 107 is shielded, clip 250 may contact the cable screen (typically folded back onto the outside of the cable) to establish electrical connection with the cable screen. The connector housing 101 may be in electrical contact with clip 250 to place the connector housing 101 in electrical connection with the cable screen.

Shield performance is quantified through a property known as Transfer Impedance (ISO IEC 11801 2$^{nd}$ Edition). Is has been proven that shield performance is dependant on both the percentage of circumferential engaged and the normal force applied. The introduction of larger ranges of cable diameters limits the ability of a traditional shield termination's ability to provide both maximum shield engagement and normal force. In the embodiment shown, a flexible shield grounding assembly 106 is forced into contact with cable shield from three separate directions simultaneously engaging a maximum amount of circumferential area 116 while also accepting a maximum range of cable diameters 107 with consistent and predictable normal force.

Figure 30:
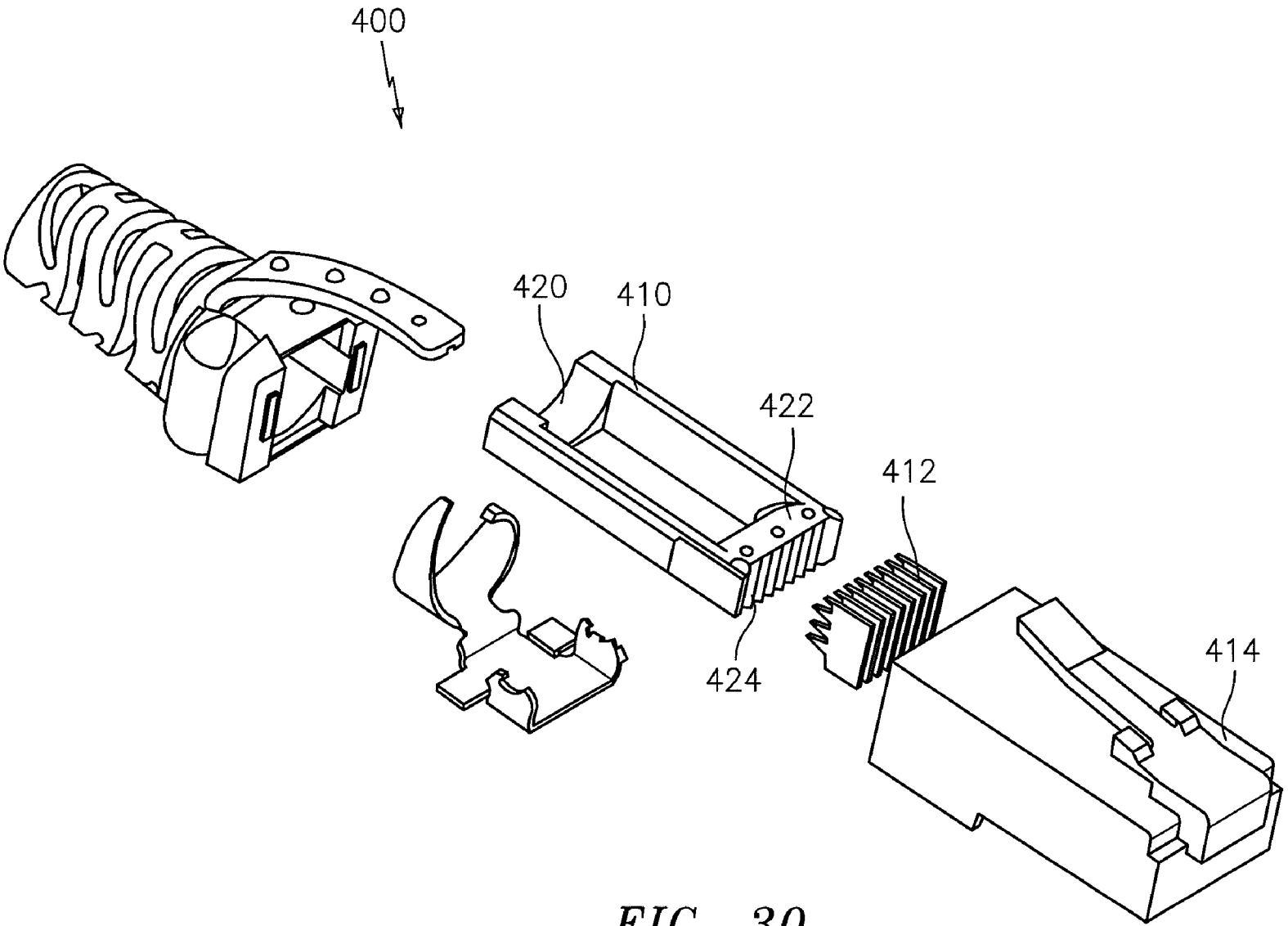
FIG. 30 is an exploded view of an exemplary connector in alternate embodiments of the invention.

FIG. 30 illustrates a telecommunications connector in an alternate embodiment. The connector 400 is a plug and includes a plug insert 410, contacts 412 and housing 414. The insert 410 includes a cable receiving area 420 that is semicircular for receiving the outside of cable 107. The insert 410 includes a termination bar 422 spaced from the cable receiving area 420. Wires may be laced over termination bar 422 in the same manner as described above with reference to the termination block 105. That is, the wires are laced over the termination bar 422 and lay in grooves 424 on a front face of the insert 410. As noted above, the wires are laced over opposite sides of the termination bar 422 such that the natural position of the wires in the cable is maintained at both ends of the cable. Two pairs of wires are laced over the top of termination bar 422 and two pairs of wires are laced over the bottom of the termination bar 422. Ends of the wires are positioned in grooves 424. Maintaining the natural lay of the wire pairs improves performance by eliminating the need for one or more wire pairs to be repositioned and cross, or be moved closer to, another wire pair.

Contact 412 is generally rectangular and includes an insulation piercing contact (IPC) along one side. The insulation piercing contacts engage wires in the grooves 424 to establish electrical contact with the wires as known in the art. Housing 414 includes a number of slots on a front face thereof for receiving the contacts 412. The contacts 412 are then exposed through slots in the housing such that the contacts 412 can make electrical contact with outlet contacts.

Connector 400 is assembled by routing a cable through a strain relief boot and into insert 410. The individual wires are laced over the termination bar 422 such that two pairs of wires are laced over the top of the termination bar and two pairs of wires are laced over the bottom of the termination bar. As noted above, this maintains the wires in their natural lay exiting the cable. The wires are positioned in grooves 424. The insert 410 is then pushed into housing 414 which may be preload with contacts 412. When the wires engages the IPCs, electrical connection is established between the wires and the contacts 412.

The embodiment of FIG. 30 illustrates the benefits of using a termination bar with any type of connector such as an outlet or a plug. The termination bar allows wires to be laced in a pattern that maintains the natural lay of the wires, thereby eliminating the need to cross wire pairs or reposition wire pairs. This reduces variability in termination and improves performance.

Embodiments of the invention provide for ease of termination of wires at the wire contacts without crossing wire pairs. This results in reduced variability and better transmission performance in the mated connector due to termination design. Reducing variability in wire termination results in reduced crosstalk and enhances the ability to compensate for crosstalk, as the crosstalk is more predictable. In addition, the application of this technique is intuitive, providing for easier training of installers, and higher rates of first pass yields.

While the invention has been described with reference to exemplary embodiments, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiments disclosed for carrying out this invention.

What is claimed is:

1. A telecommunications connector comprising:

a connector housing;

a plurality of connector contacts in the connector housing;

a substrate having first plated through holes for receiving termination ends of the connector contacts, the first plated through holes arranged in an area on the substrate;

a plurality of termination contacts, the plurality of termination contacts positioned in second plated through holes in the substrate;

at least two of the second plated through holes intersecting the area on the substrate;

wherein the substrate is rectangular, at least four of the second plated through holes being arranged along a diagonal of the substrate.

2. The telecommunications connector of claim 1 wherein:

each termination contact has a lateral axis, the substrate having a reference axis in a plane of the substrate, a first angle between the lateral axis of a first termination contact and the reference axis being different than a second angle between the lateral axis of a second termination contact and the reference axis.

3. The telecommunications connector of claim 2 wherein:

all termination contacts have a lateral axis at either the first angle with respect to the reference axis or a the second angle with respect to the reference axis.

4. A telecommunications connector comprising:

a connector housing;

a substrate having a plurality of connector contacts;

at least four termination contacts extending along a diagonal of the substrate, the substrate including traces electrically connecting the termination contacts and the connector contacts;

a termination block receiving a cable having a plurality of conductors, the termination block having a base with an opening therein for receiving the cable and a termination bar positioned above the opening;

the conductors arranged in a plurality of tip and ring pairs, the conductors laced into slot in the termination bar extending along an axis for termination with the termination contacts;

the conductors laced in the termination bar such that no pair of conductors crosses an other pair of conductors;

wherein at least four termination contacts extend along a single axis connector housing, the connector housing is rectangular and the single axis is a diagonal of the connector housing.

5. The telecommunications connector of claim 4 wherein:

the conductors are laced in the termination bar such that the lay of conductors in the cable is maintained in the termination bar.

6. The telecommunications connector of claim 4 wherein:

no pair of conductors crosses an other pair of conductors from exiting a cable to the termination bar.

7. The telecommunications connector of claim 4 wherein: all the conductors are laced in the termination bar from one side of the termination bar.

8. The telecommunications connector of claim 4 wherein: a first set of conductors are laced in the termination bar from one side of the termination bar and a second set of conductors are laced in the termination bar from an other side of the termination bar.

9. The telecommunications connector of claim 8 wherein: the termination bar includes openings positioned within each slot, the openings receiving the termination contacts.

10. The telecommunications connector of claim 4 wherein: the connector housing defines an outlet for receiving a plug.

11. The telecommunications connector of claim 4 wherein: the slots include barbs formed on the interior walls of the slots to retain conductors in the slots.

12. The telecommunications connector of claim 4 wherein: the slots having differing heights relative to the termination block base.

13. The telecommunications connector of claim 4 wherein: the termination bar includes a plurality of teeth for separating pairs of conductors into individual conductors.

14. The telecommunications connector of claim 4 wherein: the termination bar includes fins extending away from the termination bar to separate adjacent pairs of twisted conductors.

15. A telecommunications connector comprising:

a connector housing;

aplurality of termination contacts;

a termination block for receiving a cable having a plurality of conductors, the termination block having a base with an opening therein for receiving the cable and a termination bar being positioned above the opening;

the conductors arranged in a plurality of tip and ring pairs, the conductors laced into the termination bar of the termination block for termination with the termination contacts;

the conductors laced in the termination bar such that no pair of conductors crosses an other pair of conductors;

wherein the termination block includes a base having a cable recess and an arm pivotally mounted to the base, the arm covering the cable recess in a closed position.

16. The telecommunications connector of claim 15 wherein:

the arm includes a spring clip on an inside surface thereof wherein when the arm is in the closed position, the spring clip contacts a shield of a cable in the cable recess.

17. The telecommunications connector of claim 16 wherein:

wherein the spring clip applies pressure on the cable to provide strain relief.

18. A telecommunications connector comprising:

a connector housing;

a plurality of termination contacts on a substrate;

a termination block for receiving a cable having a plurality of conductors, the termination block having a base with an opening therein for receiving the cable and a termination bar positioned above the opening;

the conductors arranged in a plurality of tip and ring pairs, the conductors laced into slots in the termination bar extending along an axis for termination with the termination contacts;

the conductors laced in the termination bar such that no pair of conductors crosses an other pair of conductors;

wherein at least four termination contacts extend along a single axis of the connector housing, the connector housing is rectangular and the single axis is a diagonal of the connector housing;

each termination contact has a lateral axis, the substrate having a reference axis in a plane of the substrate, a first angle between the lateral axis of a first termination contact and the reference axis being different than a second angle between the lateral axis of a second termination contact and the reference axis.

* * * * *